US012030707B2

(12) United States Patent
Uchiyama et al.

(10) Patent No.: US 12,030,707 B2
(45) Date of Patent: Jul. 9, 2024

(54) SYNTHETIC RESIN BOTTLE

(71) Applicant: TOYO SEIKAN CO., LTD., Tokyo (JP)

(72) Inventors: Takeshi Uchiyama, Yokohama (JP); Ryouta Ishii, Yokohama (JP); Atsushi Komiya, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 731 days.

(21) Appl. No.: 16/330,686

(22) PCT Filed: Aug. 15, 2017

(86) PCT No.: PCT/JP2017/029375
§ 371 (c)(1),
(2) Date: Mar. 5, 2019

(87) PCT Pub. No.: WO2018/047586
PCT Pub. Date: Mar. 15, 2018

(65) Prior Publication Data

US 2021/0323745 A1 Oct. 21, 2021

(30) Foreign Application Priority Data

Sep. 6, 2016 (JP) ..... 2016-173672
Nov. 24, 2016 (JP) ..... 2016-228096

(51) Int. Cl.
*B65D 79/00* (2006.01)
*B65D 1/02* (2006.01)
*B65D 1/40* (2006.01)

(52) U.S. Cl.
CPC ..... *B65D 79/0084* (2020.05); *B65D 1/0223* (2013.01); *B65D 1/40* (2013.01); *B65D 2501/0027* (2013.01)

(58) Field of Classification Search
CPC ..... B65D 79/0084; B65D 1/40; B65D 1/44
(Continued)

(56) References Cited

U.S. PATENT DOCUMENTS 4,867,323 A 9/1989 Powers
D369,556 S 5/1996 Launder et al.
(Continued)

FOREIGN PATENT DOCUMENTS

CN 1039387 A 2/1990
CN 1467131 A 1/2004
(Continued)

OTHER PUBLICATIONS

Supplementary Partial European Search Report dated Apr. 22, 2020 in counterpart European Appl. 17848530.6 (13 pgs.).
(Continued)

*Primary Examiner* — Anthony D Stashick
*Assistant Examiner* — Raven Collins
(74) *Attorney, Agent, or Firm* — Foley & Lardner LLP

(57) ABSTRACT

Synthetic resin bottle (1) including tube-shaped body section (3) comprises eight decompression absorbing panels (8) disposed at equal intervals in body section (3) and pillar sections (9) respectively disposed between said decompression absorbing panels (8) and formed by arcuate wall surfaces (9*a*). Arcuate wall surfaces (9*a*) of pillar sections (9) in a cross section of body section (3) configure parts of one imaginary perfect circle (10). A total of circumferential lengths of arcuate wall surfaces (9*a*) of pillar sections (9) is 20 to 50% of a total circumferential length of perfect circle (10). Consequently, it is possible to realize the synthetic resin bottle having decompression absorbing performance in order to absorb a decrease in internal pressure, the exterior
(Continued)

of the body section of the synthetic resin bottle being seen as a cylindrical shape whose shape is almost the same as that of a perfect circle.

18 Claims, 19 Drawing Sheets

(58) Field of Classification Search
USPC ..... 215/381
See application file for complete search history.

(56) References Cited

U.S. PATENT DOCUMENTS

| | | | | |
|---|---|---|---|---|
| 6,112,925 | A | 9/2000 | Nahill et al. | |
| 7,347,339 | B2 * | 3/2008 | Bangi | B65D 1/0223 215/381 |
| 2001/0030166 | A1 | 10/2001 | Ozawa et al. | |
| 2004/0159627 | A1 | 8/2004 | Trude | |
| 2008/0314862 | A1 | 12/2008 | Matsuoka et al. | |
| 2010/0089865 | A1 * | 4/2010 | Oguchi | B65D 1/42 215/382 |
| 2015/0108081 | A1 * | 4/2015 | Boulay | B65D 1/0223 215/383 |
| 2015/0203268 | A1 * | 7/2015 | Windelinckx | B65B 3/04 220/669 |
| 2017/0021956 | A1 * | 1/2017 | Ring | B65D 1/0207 |
| 2017/0334628 | A1 * | 11/2017 | Bangi | B65D 1/46 |
| 2019/0210758 | A1 * | 7/2019 | Casper | B65D 1/42 |

FOREIGN PATENT DOCUMENTS

| | | | | |
|---|---|---|---|---|
| EP | 0957030 | * | 4/1999 | B65D 1/02 |
| JP | H10-139027 | A | 5/1998 | |
| JP | 2001-206331 | A | 7/2001 | |
| JP | 3088764 | U | 9/2002 | |
| JP | 2002-370721 | A | 12/2002 | |
| JP | 2006-321522 | A | 11/2006 | |
| JP | 2006-335383 | A | 12/2006 | |
| JP | 2009-035267 | A | 2/2009 | |
| JP | 2010-215242 | A | 9/2010 | |
| JP | 2014-043275 | | 3/2014 | |
| JP | 2014-118205 | A | 6/2014 | |
| JP | 2015-131664 | A | 7/2015 | |
| JP | 2016-101975 | A | 6/2016 | |
| JP | 2016-108016 | A | 6/2016 | |
| WO | WO-2015/187761 | A1 | 12/2015 | |

OTHER PUBLICATIONS

International Search Report dated Oct. 17, 2017 in PCT/JP2017/029375 with English-language translation (8 pgs.).
Office Action dated Nov. 28, 2019 in Chinese Appl. 201780054404.0 with English-language translation (13 pgs.).
Extended European Search Report dated Aug. 25, 2020 in counterpart European Appl. 17848530.6 (13 pgs.).
Japanese Office Action dated Jun. 29, 2021 as issued in Japanese Application No. 2016-173672, English Translation, 9 pages.
European Office Action dated Jul. 14, 2021 as issued in European Application No. 17848530.6, English Translation, 6 pages.
Foreign Action other than Search Report on U.S. Appl. No. 16/330,686 dated Jan. 25, 2022.

* cited by examiner

Convex Geometrical Shape Section

Concave Geometrical Shape Section

SYNTHETIC RESIN BOTTLE

CROSS REFERENCE TO RELATED APPLICATIONS

This application is a national stage entry of International Appl. No. PCT/JP2017/029375, filed Aug. 15, 2017; which claims priority to Japanese Appl. No. 2016-173672, filed Sep. 6, 2016, and Japanese Appl. No. 2016-228096, filed Nov. 24, 2016; the contents of which are incorporated by reference herein in their entirety.

TECHNICAL FIELD

The present invention relates to a synthetic resin bottle and, more particularly, to a synthetic resin bottle in which the exterior of a body section, on the outer circumferential portion of which a label is attached, is seen as a cylinder whose shape is almost the same as that of a perfect circle.

BACKGROUND ART

A synthetic resin bottle for a beverage made of synthetic resin such as PET (polyethylene terephthalate) has various advantages such as a low price and light weight. In a bottle for a noncarbonated beverage, hot filling for heating a beverage to high temperature to sterilize the beverage and filling the beverage in a heat-resistance bottle in a state of the high temperature and sealing the bottle, or aseptic filling for heating a beverage to high temperature for a short time to sterilize the beverage, sterilizing a bottle with a chemical agent or the like, filling the beverage in the bottle at normal temperature (approximately 30° C.) under an aseptic condition, and sealing the bottle are performed. In the bottle (aseptic bottle) in which the aseptic filling is performed, in an unopened state, a decrease in internal pressure (decompression) due to a decrease of the beverage by moisture permeation over time from the inside to the outside of a container, a decrease of gas in a head space by dissolution into the beverage, a volume decrease of the beverage during refrigeration storage, or the like occurs. Deformation is likely to be caused by the decrease in the internal pressure. In order to prevent such deformation, a decompression-absorbing recessed section is provided in the body section.

A synthetic resin bottle described in Patent Document 1 includes a decompression absorbing section formed by a cone-shaped recessed section in which a spiral concave groove is formed, on a bottom plate, and includes a reinforced section formed by a plurality of circumferential grooves arranged in parallel in the height direction, on a body section.

A plastic bottle described in Patent Document 2 is a heatable and fillable octahedron bottle in which the cross section of a bottle body section is octagonal, arcuate wall surfaces are formed at corner portions, and decompression absorbing surfaces formed by inclined walls and flat walls are disposed between the arcuate wall surfaces. The plastic bottle includes a decompression absorbing surface having a pillar angle which is formed by the inclined walls connected to both sides of the arcuate wall surface and which is in a range of 60° to 115°.

In a resin container described in Patent Document 3, a continuous pattern formed by projecting sections and non-projecting sections is formed in a body section. The resin container is less easily dented even if negative pressure is generated on the inside of the resin container.

In a plastic bottle described in Patent Document 4, an uneven pattern in which large numbers of recessed sections and projecting sections are arranged at random is formed. The plastic bottle has an advantage that non-constant deformation hardly occurs caused because when a decrease in internal pressure occurs, stress caused by the decrease in the internal pressure is distributed to most part of an entire body section on which the uneven pattern is formed, and the stress is absorbed due to the deformation at the most part of an entire body section.

In a cylindrical decorative container described in Patent Document 5, a plurality of belt-like waveforms, an amplitude direction which is the major axis direction of a cylinder portion and a wavelength direction which is the circumferential direction of the cylinder portion, are arrayed in parallel along the major axis direction of the cylinder portion on the outer side surface of the cylinder portion.

PRIOR ART DOCUMENTS

Patent Documents

Patent Document 1: JP2015-131664A
Patent Document 2: JP2001-206331A
Patent Document 3: JP3088764U
Patent Document 4: JP10-139027A
Patent Document 5: JP2009-35267A

SUMMARY OF INVENTION

Problem to be Solved by the Invention

In the synthetic resin bottle in which the decompression absorbing section is provided in the bottom plate and the reinforced section formed by the plurality of cylindrical grooves (beads) arranged in parallel in the height direction is provided in the body section disclosed in Patent Document 1, or the plastic bottle disclosed in which the decompression absorbing surface (the decompression-absorbing recessed section) is disposed in the bottle body section disclosed in Patent Document 2, when a label, in particular, a shrink label made of a thermal contraction film is attached to the body section, the beads or the decompression-absorbing recessed section give a particular exterior appearance in the synthetic resin bottle. Such an exterior appearance of the synthetic resin bottle sometimes is not suitable for a container depending on a type of a beverage filled and sealed in the synthetic resin bottle. For example, it is sometimes preferred that the exterior appearance of the body section of the synthetic resin bottle has a perfect circle cylindrical shape similar to a bottle made of glass or metal. However, in the synthetic resin bottle, it is difficult to achieve both the aforementioned decompression absorbing performance and a perfect circle cylindrical shape of the exterior appearance of the body section to which the label is attached.

The resin container disclosed in Patent Document 3 prevents deformation (dent) due to a decrease in internal pressure by the continuous pattern, and the plastic bottle disclosed in Patent Document 4 also prevents deformation (dent) due to a decrease in internal pressure by the uneven pattern arranged at random. However, even in Patent Documents 3 and 4, it is difficult to achieve both decompression absorbing performance and an exterior appearance having a perfect circular body section.

The cylindrical decorative container disclosed in Patent Document 5 can be shown in a polygonal column shape, although the cylindrical decorative container actually has a cylindrical shape. However, the cylindrical decorative container does not include a decompression-absorbing recessed section for exerting decompression absorbing performance. Therefore, Patent Document 5 does not indicate a technique for showing the exterior appearance of a body section including a decompression-absorbing recessed section in a perfect circle cylindrical shape.

An object of the present invention to provide a synthetic resin bottle having decompression absorbing performance to absorb a decrease in internal pressure, the exterior appearance of a body section of the synthetic resin bottle, to which a label is attached, being seen in a cylindrical shape whose shape is almost the same as that of a perfect circle.

Means to Solve the Problem

In an aspect of the present invention, a synthetic resin bottle including a tube-shaped body section comprises: eight decompression absorbing panels disposed at equal intervals in the body section; and pillar sections respectively disposed between the decompression absorbing panels and formed by arcuate wall surfaces, the arcuate wall surfaces of the pillar sections in a cross section of the body section configure parts of one imaginary perfect circle, and a total of circumferential lengths of the arcuate wall surfaces of the pillar sections is 20 to 50% of a total circumferential length of the perfect circle.

In another aspect of the present invention, a synthetic resin bottle including a tube-shaped body section comprises: eight decompression absorbing panels disposed at equal intervals in the body section; and pillar sections respectively disposed between the decompression absorbing panels and formed by arcuate wall surfaces, the arcuate wall surfaces of the pillar sections in a cross section of the body section configure parts of imaginary one perfect circle, and an angle formed by a radial direction line passing through a circumferential direction center of the pillar section and a radial direction line passing through an edge of the pillar section in a circumferential direction is 20 to 50% of an angle formed by the radial direction line passing through the circumferential direction center of the pillar section and a radial direction line passing through a circumferential direction center of the decompression absorbing panel adjacent to the pillar section.

In another aspect of the present invention, in a synthetic resin bottle including a tube-shaped body section, the body section comprises a plurality of decompression absorbing panels, and a plurality of geometrical shape sections are regularly disposed side by side over an entire circumference of the body section.

Advantageous Effects of Invention

According to the present invention, it is possible to realize a synthetic resin bottle having decompression absorbing performance to absorb a decrease in internal pressure, the exterior appearance of a body section of the synthetic resin bottle, to which a label is attached, being seen in a cylindrical shape whose shape is almost the same as that of a perfect circle.

EMBODIMENTS OF THE INVENTION

Embodiments of the present invention are explained below with reference to the drawings.

[Basic Structure of a Synthetic Resin Bottle]

Figure 1:
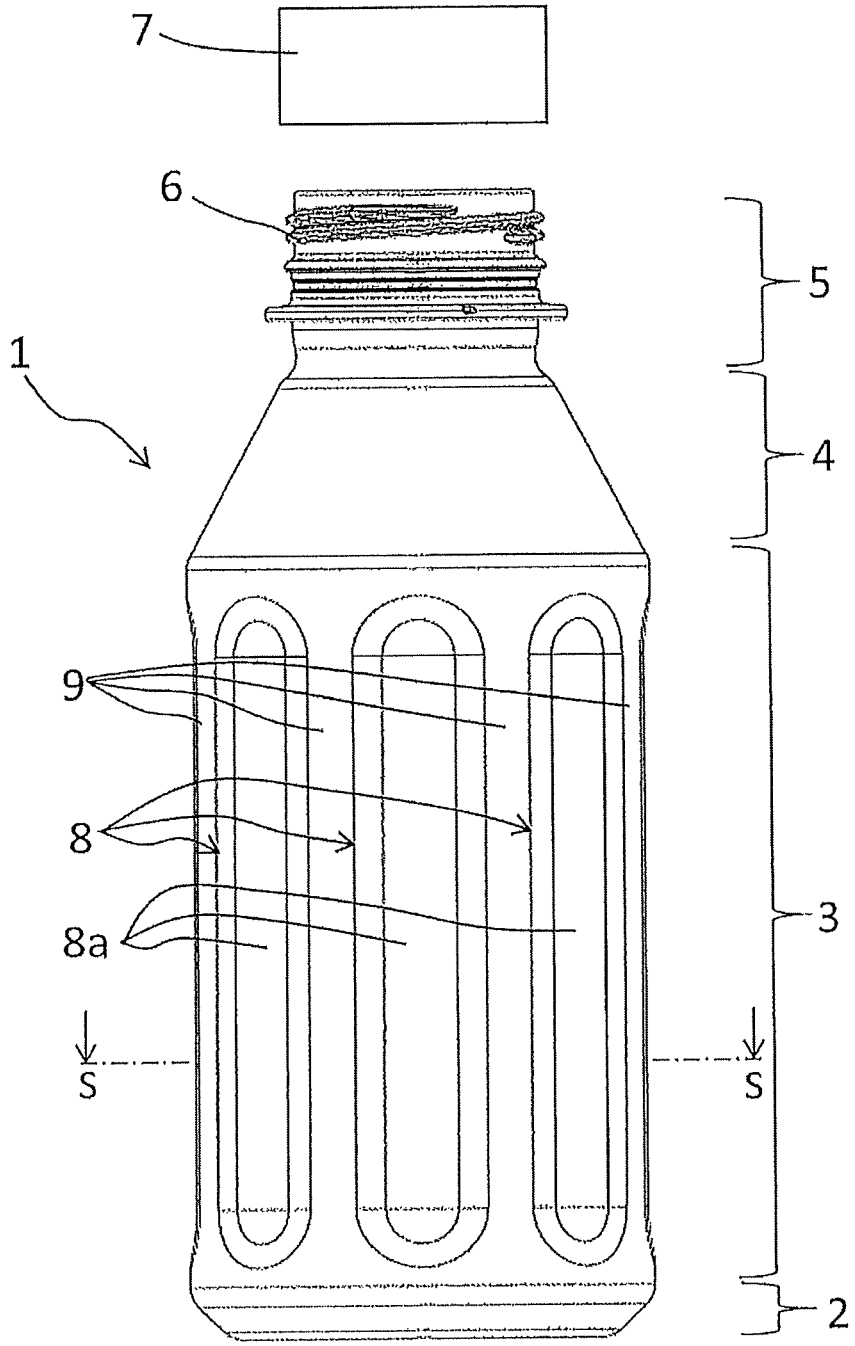
FIG. 1 is a front view of a synthetic resin bottle in a first embodiment of the present invention.
Figure 2:
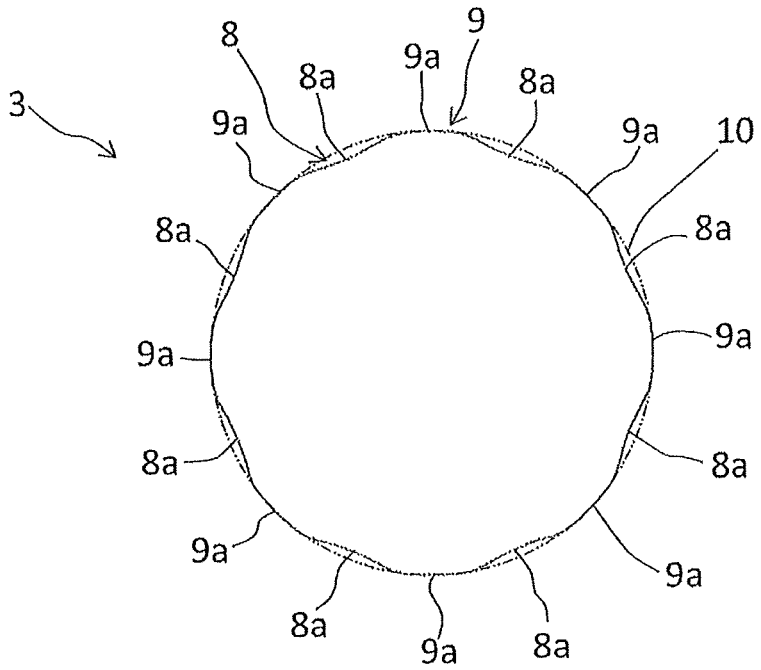
FIG. 2 is a cross sectional view schematically showing, with a contour line, an external shape of a position indicated by S-S line in FIG. 1.
Figure 3:
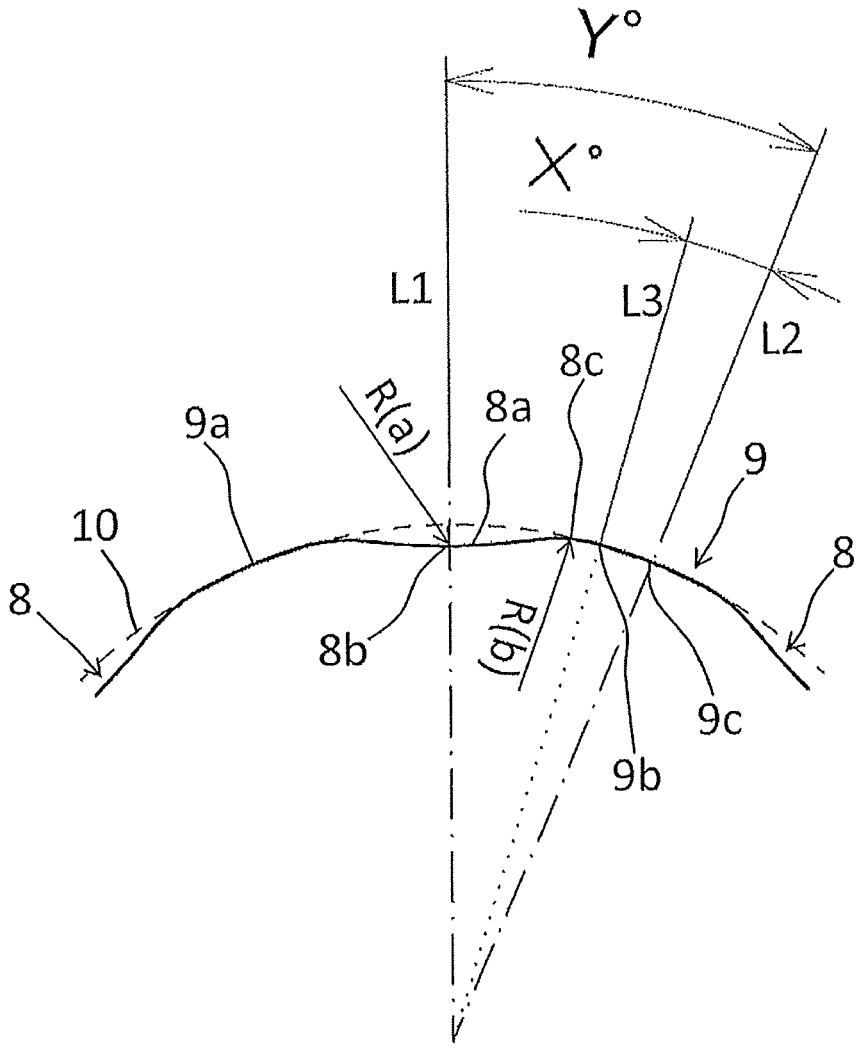
FIG. 3 is an enlarged cross sectional view of a part of FIG. 2.

FIG. 1 shows a front view of synthetic resin bottle 1 in a first embodiment of the present invention. FIG. 2 schematically shows a cross sectional shape along S-S line in FIG. 1. FIG. 3 enlarges and shows a part of FIG. 2. This synthetic resin bottle 1 is mainly made of synthetic resin such as polyethylene terephthalate (PET) and is molded by performing biaxial stretch blow molding of a preform molded by well-known blow molding, for example, injection molding or compression molding. Synthetic resin bottle 1 stores and preserves a noncarbonated beverage such as coffee or tea. Synthetic resin bottle 1 is particularly suitable for the aseptically filled beverage explained above. This synthetic resin bottle 1 is a bottle in which, as shown in FIG. 1, heel section (bottom section) 2, tube-shaped body section 3, taper-shaped (substantially conical) shoulder section 4 tapered upward, and small-diameter neck section 5 are provided upward from the bottom. Synthetic resin bottle 1 is capable of self-supporting in a state in which the lowest portion (a grounding portion) of heel section 2 is placed on a plane (e.g., a top surface of a desk or a table or a floor surface). An end portion of neck section 5 is an opening section functioning as a spout. Male screw section 6 is provided in the outer circumference of the opening section. After a beverage is filled, screw cap 7 including a female screw section (not illustrated) is screwed with male screw section 6 to seal the opening section.

[Structure of the Body Section]

As shown in FIGS. 1 and 2, eight decompression absorbing panels 8 whose top and bottom are formed in an arcuate shape, are disposed at equal intervals in body section 3 of synthetic resin bottle 1. Pillar sections 9 are respectively provided between decompression absorbing panels 8. Decompression absorbing panels 8 include recessed sections 8*a*. As shown in FIGS. 2 and 3, pillar sections 9 are formed by arcuate wall surfaces 9*a*. Arcuate wall surfaces 9*a* of all pillar sections 9 in a cross section of body section 3 respectively configure parts of one imaginary perfect circle 10. On the other hand, wall surfaces of decompression absorbing panels 8 have a concave shape or a planar shape and do not overlap perfect circle 10 imaginarily configured by connecting arcuate wall surfaces 9*a* of all pillar sections 9. In the present invention, in the cross section (e.g., a cross section along S-S line) of body section 3, a total of circumferential lengths of arcuate wall surfaces 9*a* of pillar sections 9 (referred to as "total circumferential length A of all pillar sections") is 20 to 50% of the total circumferential length of perfect circle 10 imaginarily configured by connecting arcuate wall surfaces 9*a* of all pillar sections 9 (referred to as "total circumferential length B of perfect circle"). In an illustrated specific example, total circumferential length A of all pillar sections is 27% of total circumferential length B of perfect circle.

In body section 3 of synthetic resin bottle 1, when the circumferential direction lengths of all decompression absorbing panels 8 are equal, all pillar sections 9 have the same shape, and the circumferential direction lengths of pillar sections 9 are equal, ratio A/B of total circumferential length A of all pillar sections to total circumferential length B of perfect circle explained above can be calculated as follows. That is, as shown in FIG. 3, in the cross section, with reference to angle Y formed by radial direction line L1 passing through circumferential direction center 8*b* of decompression absorbing panel 8 and radial direction line L2 passing through circumferential direction center 9*c* of pillar section 9 adjacent to decompression absorbing panel 8, and angle X formed by radial direction line L2 and radial direction line L3 passing through edge 9*b* in the circumferential direction between pillar section 9 and decompression absorbing panel 8, ratio X/Y is equivalent to ratio A/B of the lengths explained above. Edge 9*b* in the circumferential direction of pillar section 9 is a point where a curvature of arcuate wall surface 9*a* changes and is a point of a boundary between the portion overlapping imaginary perfect circle 10 and the portion not overlapping imaginary perfect circle 10. Note that both the numbers of decompression absorbing panels 8 and pillar sections 9 in this embodiment are eight. Therefore, the angle Y is 360°/16=22.5°.

A technical significance of setting total circumferential length A of all pillar sections to 20 to 50% of a total circumferential length B of perfect circle as explained above in this embodiment is explained.

In general synthetic resin bottle 1, total circumferential length A of all pillar sections in the cross section of body section 3 is 10% or less of total circumferential length B of perfect circle. In other words, the ratio occupied by decompression absorbing panels 8 is approximately 90% or more. It is possible to sufficiently absorb decompression and reduce deformation of container 1. However, most of body section 3 is configured from decompression absorbing panels 8 whose wall surfaces have a concave shape or a planar shape rather than an arcuate shape. Therefore, a cross sectional shape is a substantially polygonal shape. The exterior appearance of body section 3 attached with a shrink label is a substantially polygonal column shape.

On the other hand, in the synthetic resin bottle of the present invention, for the structure of the body section explained above, a design condition for forming the exterior appearance of body section 3 (see FIG. 4) attached with the shrink label in a cylindrical shape whose shape is almost the same as that of perfect circle 10 and for maintaining decompression absorbing performance is derived. First, decompression over time in an unopened state of synthetic resin bottle 1 filled with a beverage by aseptic filling is mainly due to a volume decrease of oxygen by dissolution of oxygen in a head space of neck section 5 into the beverage and a volume decrease by slight moisture permeation from body section 3 of the beverage stored in synthetic resin bottle 1. On the other hand, decompression of a synthetic resin bottle filled with a beverage by hot filling is due to a volume decrease by a temperature decrease of the beverage filled and sealed at high temperature and the gas in the head pace to the normal temperature in addition to the volume decrease similar to the volume decrease of synthetic resin bottle 1 filled with the beverage by the aseptic filling. Therefore, a necessary amount of decompression absorption in the synthetic resin bottle for the aseptic filling (aseptic bottle) 1 is smaller than that in the synthetic resin bottle for the hot filling (a heat-resistant bottle). For example, in an aseptic bottle having an inner capacity of approximately 400 ml (height: 162 mm, diameter of the body section: 66 mm, length of the body section: 103 mm, and a bore: 38 mm), a necessary amount of decompression absorption is approximately 7 ml in approximately one year. Considering such a difference in the volume decrease, the inventor found that decompression absorbing panels 8 need to occupy 50% or more of the entire wall surface of body section 3 in order to secure the size of decompression absorbing panel 8 that absorbs decompression and does not cause excessive deformation. Therefore, in this embodiment, total circumferential length A of pillar sections 9 in the cross section of body section 3 is set to 50% or less of total circumferential length B of perfect circle 10 to secure the size of the decompression absorbing panels 8 and enable decompression absorption. Note that, in order to obtain sufficient decompression absorbing performance, the length in the vertical direction of decompression absorbing panels 8 is preferably 70% or more of the entire length in the vertical direction of body section 3.

On the other hand, when a ratio of body section 3 occupied by decompression absorbing panels 8 whose wall surfaces have a concave shape or a planar shape, is excessively large, the cross sectional shape of body section 3 is a substantially polygonal shape. Therefore, in the present invention, it is possible to form the exterior appearance of body section 3 attached with the shrink label in a cylinder shape whose shape is almost the same as that of perfect circle 10 by setting total circumferential length A of all pillar sections in the cross section of body section 3 to 20% or more of total circumferential length B of perfect circle and by setting the number of decompression absorbing panels to eight. Note that, when the number of decompression absorbing panels 8 is small, the respective decompression absorbing panels 8 have to be increased in size in order to obtain decompression absorbing performance, and therefore, the concave or planar wall surface increases in size, and it is difficult to form the exterior appearance of body section 3 attached with the shrink label in the cylindrical shape whose shape is almost the same as that of perfect circle 10. On the other hand, when the number of decompression absorbing panels 8 is large, since respective decompression absorbing panels 8 decrease in size and the decompression absorbing performance greatly decreases, necessary decompression absorbing performance cannot be obtained. Therefore, considering these circumstances, in this embodiment, the number (eight) of decompression absorbing panels of the synthetic resin bottle and a ratio of total circumferential length A of all pillar sections to total circumferential length B of perfect circle in the cross section of body section 3 (20% or more, that is, two times or more of the ratio in the past) are specified.

Figure 4:
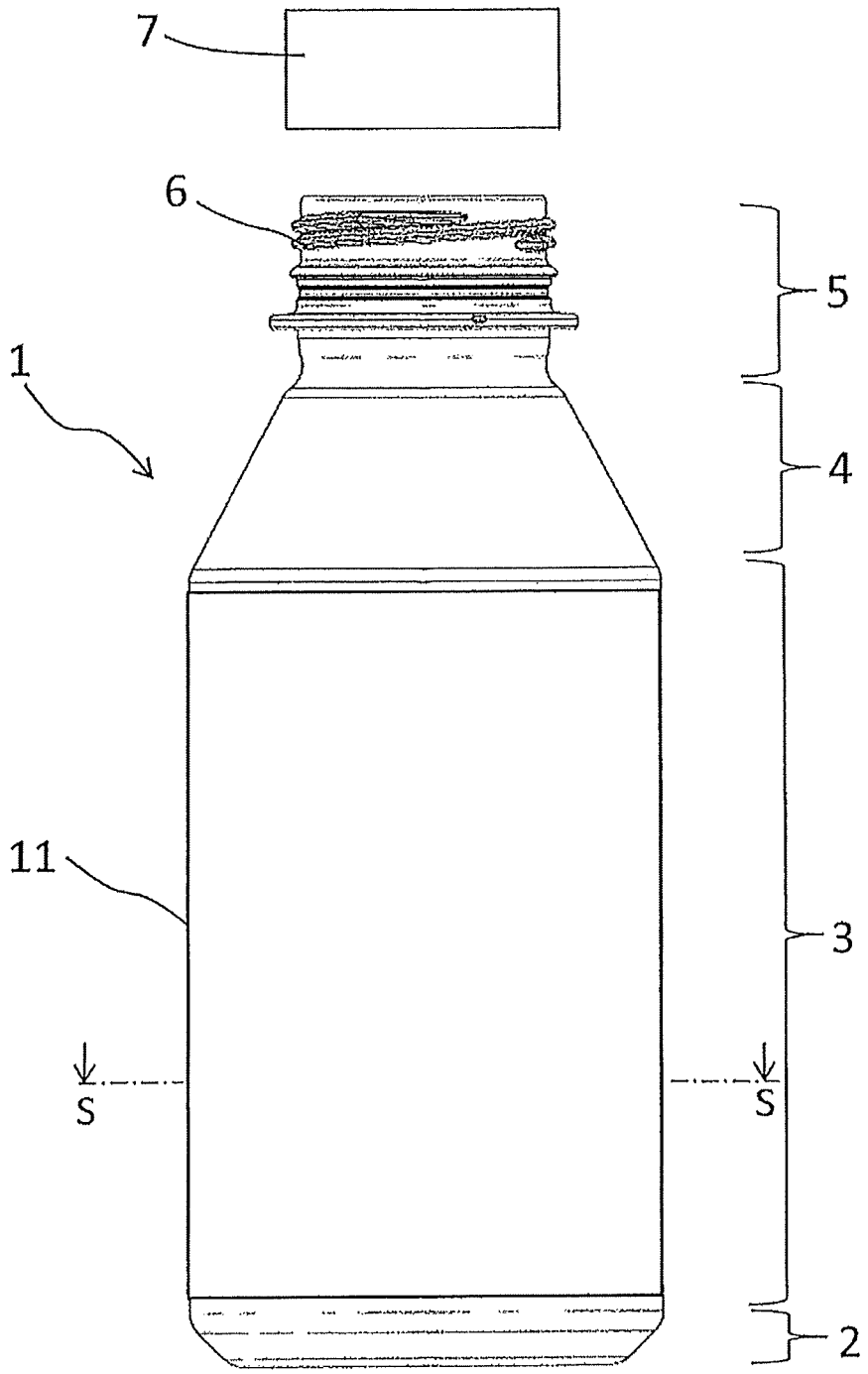
FIG. 4 is a front view showing a state in which a shrink label is attached to the synthetic resin bottle shown in FIG. 1.
Figure 5:
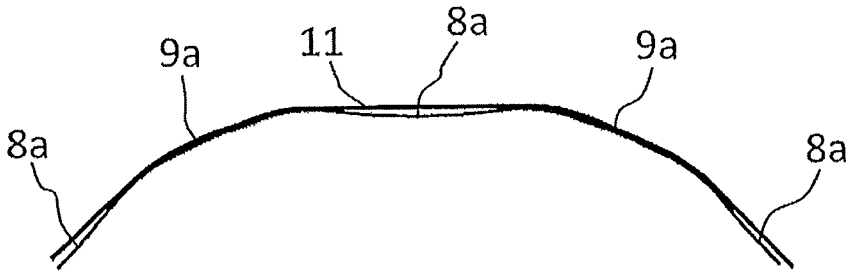
FIG. 5 is an enlarged cross sectional view schematically showing, with a contour line, a part of an external shape of a position indicated by S-S line in FIG. 4.

As shown in FIGS. 4 and 5, shrink label 11 made of a heat-shrinkable film is attached to the outer surface of body section 3 of synthetic resin bottle 1 in this embodiment. As schematically shown in an enlarged cross sectional view in FIG. 5, shrink label 11 is mainly attached to arcuate wall surfaces 9*a* of pillar section 9. Shrink label 11 covers recessed sections 8*a* of decompression absorbing panel 8 in a state in which shrink label 11 does not adhere to recessed sections 8*a* and slightly floats. As a result, with shrink label 11, the exterior appearance of body section 3 assumes a cylindrical shape whose shape is almost the same as that of perfect circle 10. However, when edge 9*b* (see FIG. 3), which is the boundary between decompression absorbing panel 8 and pillar section 9, is acute and shrink label 11 comes into press contact with edge 9*b*, a line extending in the longitudinal direction (the vertical direction) is formed in shrink label 11. The exterior appearance gives an impression like a polygonal column. Therefore, the cross sectional shape (see FIG. 3) of end portion 8*c* of decompression absorbing panel 8 connected to edge 9*b* of pillar section 9 is preferably formed in a rounded and curved shape. The formation of the line explained above is prevented by setting curvature radius R(b) of the curved shape explained above to 5 mm or more. Shrink label 11 does not hinder the purpose in which the exterior appearance of body section 3 assumes a cylindrical shape whose shape is almost the same as that of perfect circle 10. In a preferable example, curvature radius R(b) is approximately 10 mm.

[Heating Deformation]

Figure 6:
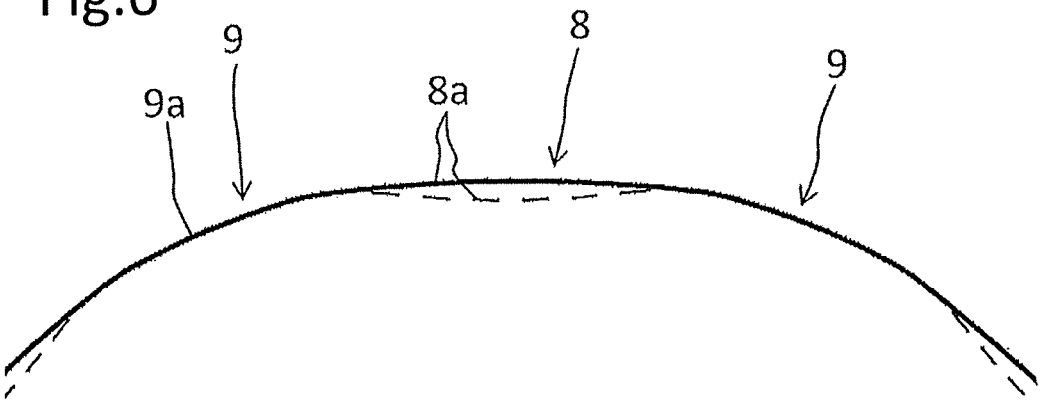
FIG. 6 is an enlarged cross sectional view schematically showing, with contour lines, parts of external shapes of the synthetic resin bottle filled with a beverage shown in FIG. 1, before heating and after the heating.

When synthetic resin bottle 1 in this embodiment is filled with a beverage and sealed, heated to temperature of, for example, approximately 50° C. to 60° C., and then the warmed beverage in the synthetic resin bottle 1 is sold by using a hot warmer, a hot vendor, or the like, the internal pressure rises due to, for example, expansion of the internal air and content fluid. According to the rise of the pressure, as schematically shown in an enlarged cross sectional view of FIG. 6, recessed sections 8*a* of decompression absorbing panels 8 are deformed to bulge in a convex shape outward and are aligned with arcuate wall surfaces 9*a* of pillar sections 9. The cross sectional shape of recessed sections 8*a* changes to a substantially arcuate shape. Body section 3 of synthetic resin bottle 1 assumes a cylindrical shape whose shape is almost the same as that of perfect circle 10. It can be further expected that the exterior appearance of body section 3 is formed in a cylindrical shape whose shape is much closer to that of perfect circle 10. In FIG. 6, the shape of recessed section 8*a* before the deformation (before the heating) is indicated by a broken line, and the shape of recessed section 8*a* after the deformation (after the heating) is indicated by a solid line. The deformation of recessed section 8*a* of decompression absorbing panel 8 shows a tendency in which when curvature radius R(a) of recessed section 8*a* of decompression absorbing panel 8 is small, outward bulging deformation in a convex shape of recessed section 8*a* occurs less easily even if synthetic resin bottle 1 is heated and body section 3 of synthetic resin bottle 1 does not assume a cylindrical shape whose shape is almost the same as that of perfect circle 10. On the other hand, the deformation of recessed section 8*a* of decompression absorbing panel 8 shows a tendency that, when curvature radius R(a) of recessed section 8*a* is large, recessed section 8*a* bulges outward in a convex shape when synthetic resin bottle 1 has high temperature, and body section 3 of bottle 1 assumes a cylindrical shape whose shape is almost the same as that of perfect circle 10.

Figure 7:
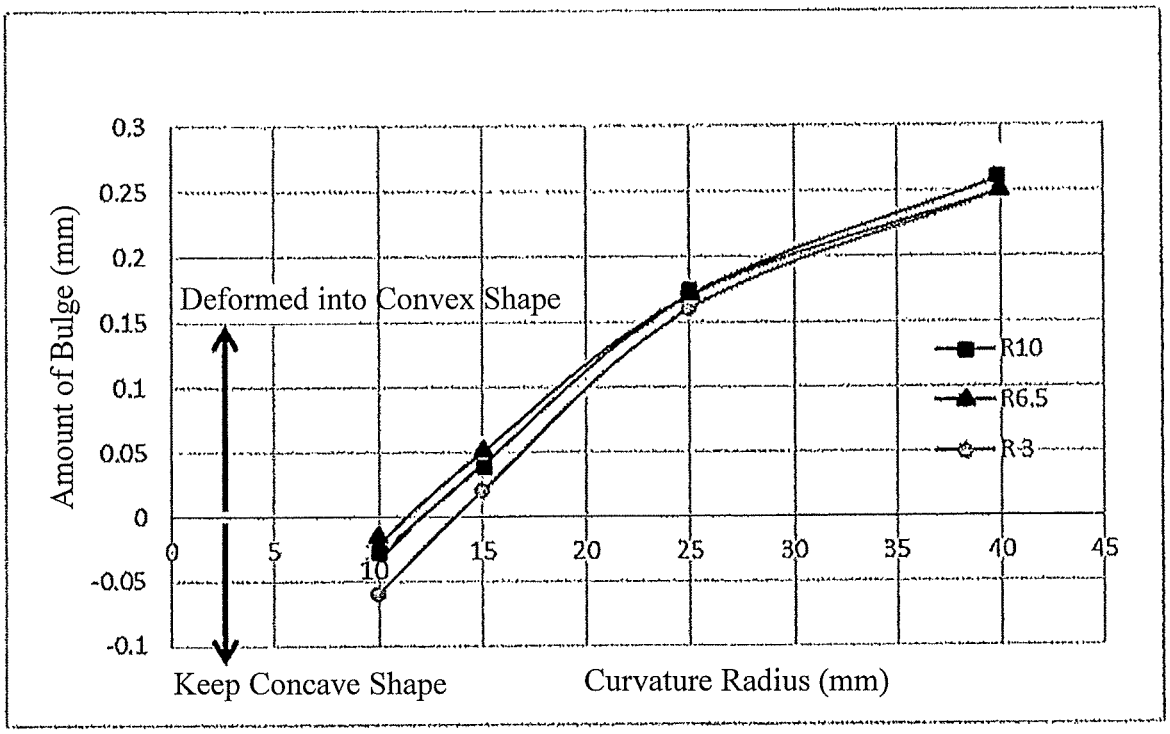
FIG. 7 is a graph showing a relation between a curvature radius of a recessed section of a decompression absorbing panel of the synthetic resin bottle filled with the beverage shown in FIG. 6 and an amount of swell in a heated state.

A result obtained by analyzing the shape of recessed section 8*a* of decompression absorbing panel 8 after the heating explained above is shown in FIG. 7. In this analysis, curvature radius R(b) in the cross section of end portion 8*c* of decompression absorbing panel 8 is set to three sizes of 3 mm, 6.5 mm, and 10 mm, and the curvature radium R(a) in the cross section of recessed section 8*a* is set to four sizes of 10 mm, 15 mm, 25 mm, and 40 mm. The amounts of bulge of recessed section 8*a* after the heating in various combinations of the various sizes are shown in FIG. 7. The amount of bulge is indicated as 0 mm when there is no bulge and no recess and the wall surface has a flat linear shape, the amount of bulge is indicated as a negative value when the wall surface is recessed inward, and the amount of bulge is indicated as a positive value when the wall surface has an outward convex shape. According to the analysis result shown in FIG. 7, in all the cases in which curvature radius R(b) of end portion 8*c* of decompression absorbing panel 8 is 3 mm, 6.5 mm, and 10 mm, outward bulging deformation in a convex shape of recessed section 8*a* does not occur during the heating, and recessed section 8*a* keeps the inward concave shape when curvature radius R(a) of recessed section 8*a* is 10 mm or less. Therefore, in these cases, the deformation by the heating does not contribute much to forming body section 3 of bottle 1 in a cylindrical shape whose shape is almost the same as that of perfect circle 10. On the other hand, when curvature radius R(a) of recessed section 8*a* is 15 mm or more, it is seen that recessed section 8*a* bulges outward in a convex shape by heating irrespective of curvature radius R(b) of end portion 8*c* of decompression absorbing panel 8 and the deformation by heating contributes to realization of formation of body section 3 of bottle 1 in a cylindrical shape whose shape is almost the same as that of perfect circle 10. Consequently, in synthetic resin bottle 1 in this embodiment, in order to sell warmed beverage in the bottle 1 as explained above and form body section 3 of bottle 1 in a cylindrical shape whose shape is almost the same as that of perfect circle 10, it is effective that curvature radius R(a) of recessed section 8*a* of decompression absorbing panel 8 is 15 mm or more.

Second Embodiment

Figure 8:
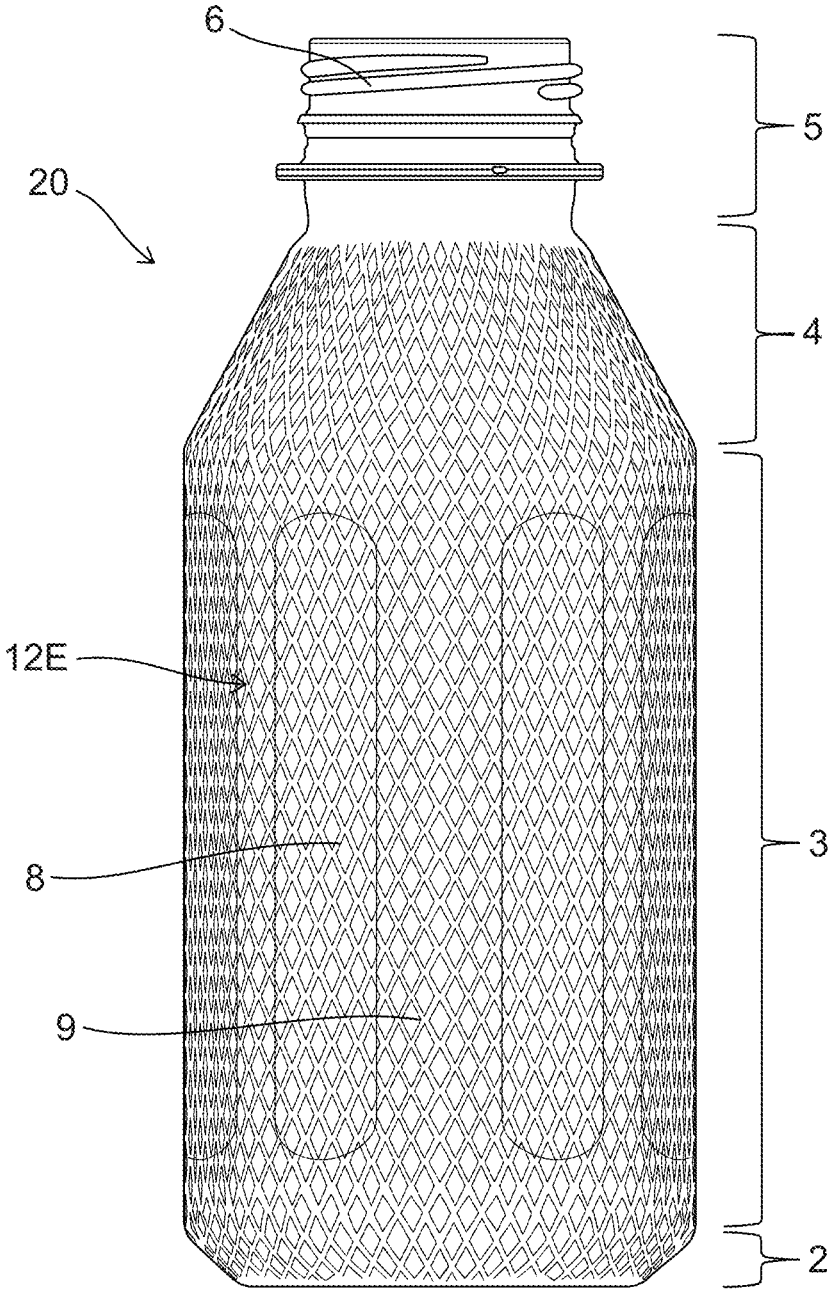
FIG. 8 is a front view of a synthetic resin bottle in a second embodiment of the present invention.

In FIG. 8, synthetic resin bottle 20 in the second embodiment of the present invention is shown. In this synthetic resin bottle 20, a large number of very small concavities and convexities are formed over the entire outer circumferential surfaces of heel section 2, body section 3, and shoulder section 4. A shape having such a large number of very small concavities and convexities is referred to as "embossed section 12E" herein. In synthetic resin bottle 1 in the first embodiment of the present invention explained above, when embossed section 12E is formed on the outer circumferential surfaces, it is possible to give an impression that the exterior appearance of body section 3 of the synthetic resin bottle is closer to a cylindrical shape that approximates the shape of perfect circle 10. That is, embossed section 12E is considered to be a kind of decorative section 12 (see third embodiment) explained below for causing a visual illusion that the outer circumference of body section 3 is a perfect circle. A reason why embossed section 12E gives the impression that the exterior appearance like a cylindrical shape approximates that of perfect circle 10 is explained. Note that embossed section 12E only has to be formed in at least body section 3.

One of major factors that cause the shape of the exterior appearance of the body section of the synthetic resin bottle to appear to be in the shape of a polygonal column rather than a perfect circle cylinder is that edge 9*b* located in the boundary between decompression absorbing panel 8 and pillar section 9 or the vicinity of edge 9*b* is recognized as a line extending in the vertical direction (the up-down direction). That is, when the line extending in the vertical direction is recognized, the shape of the body section of the bottle is not recognized as a curved surface but is recognized as if a plane and a plane are joined and a portion of the joining is seen as the line extending in the vertical direction. As a result, the shape of the body section of the synthetic resin bottle is recognized as the polygonal column rather than a perfect circle cylinder. Therefore, if the line extending in the vertical direction is made less conspicuous, it is easy to give an impression that the shape of the body section is a perfect circle cylinder. That is, as shown in FIG. 8, when embossed section 12E is provided on the outer circumferential surface of body section 3 of synthetic resin bottle 20, even if a line extends in the vertical direction is formed at edge 9*b* or the vicinity of edge 9*b*, the line is less conspicuous because the large number of very small concavities and convexities of embossed section 12E come into view. As a result, since the line is less easily recognized, an impression that the shape of the body section is the perfect circle cylinder is given. In the synthetic resin bottle in this embodiment, it is possible to intentionally make use of a visual illusion in this way to effectively give an impression that the shape of body section 3 of synthetic resin bottle 20 is a cylindrical shape whose shape is almost the same as that of perfect circle 10. In particular, in giving an impression as if the shape of body section 3 is a cylinder of perfect circle 10, it is more effective to form embossed section 12E shown in FIG. 8 in addition to setting curvature radius R(b) shown in FIG. 3 to 5 mm or more as explained above. From this view point, it is considered that embossed section 12E has to be provided at least only at edge 9*b* and the vicinity of edge 9*b*. However, in order to prevent impressions of the exterior appearances of embossed section 12E and the other portions from being greatly different, it is preferable to form embossed section 12E over the entire outer circumferential surface of body section 3. When a beverage is filled, sealed in synthetic resin bottle 20 and sold while being warmed, embossed section 12E also achieves the effect of preventing a purchaser from easily feeling heat (preventing heat from being easily transferred to the purchaser) when the purchaser holds synthetic resin bottle 20.

In the example shown in FIG. 8, in embossed section 12E, approximately one to eight (as an example, 4.5) projecting sections are formed per 1 $cm^2$ by forming a plurality of thin groove-like recessed sections crossing one another. The depth of the recessed sections is approximately 0.1 to 0.5 mm (as an example, 0.3 mm).

Note that, in synthetic resin bottle 20 in this embodiment as well, total circumferential length A of all of pillar sections in the cross section of body section 3 is 20 to 50% of total circumferential length B of perfect circle. Concerning the other components, explanation is omitted because the components are the same as the components in the first embodiment explained above.

[Modification]

The synthetic resin bottles in the first and second embodiments explained above include decompression absorbing panels 8 having a shape extending along the vertical direction. However, the synthetic resin bottles can also include decompression absorbing panels 8 inclined with respect to the vertical direction. In that case, pillar sections 9 also have a shape inclined with respect to the vertical direction. An inclination angle of decompression absorbing panels 8 and pillar sections 9 with respect to the vertical direction is preferably 30 degrees or less.

Third Embodiment

Figure 9:
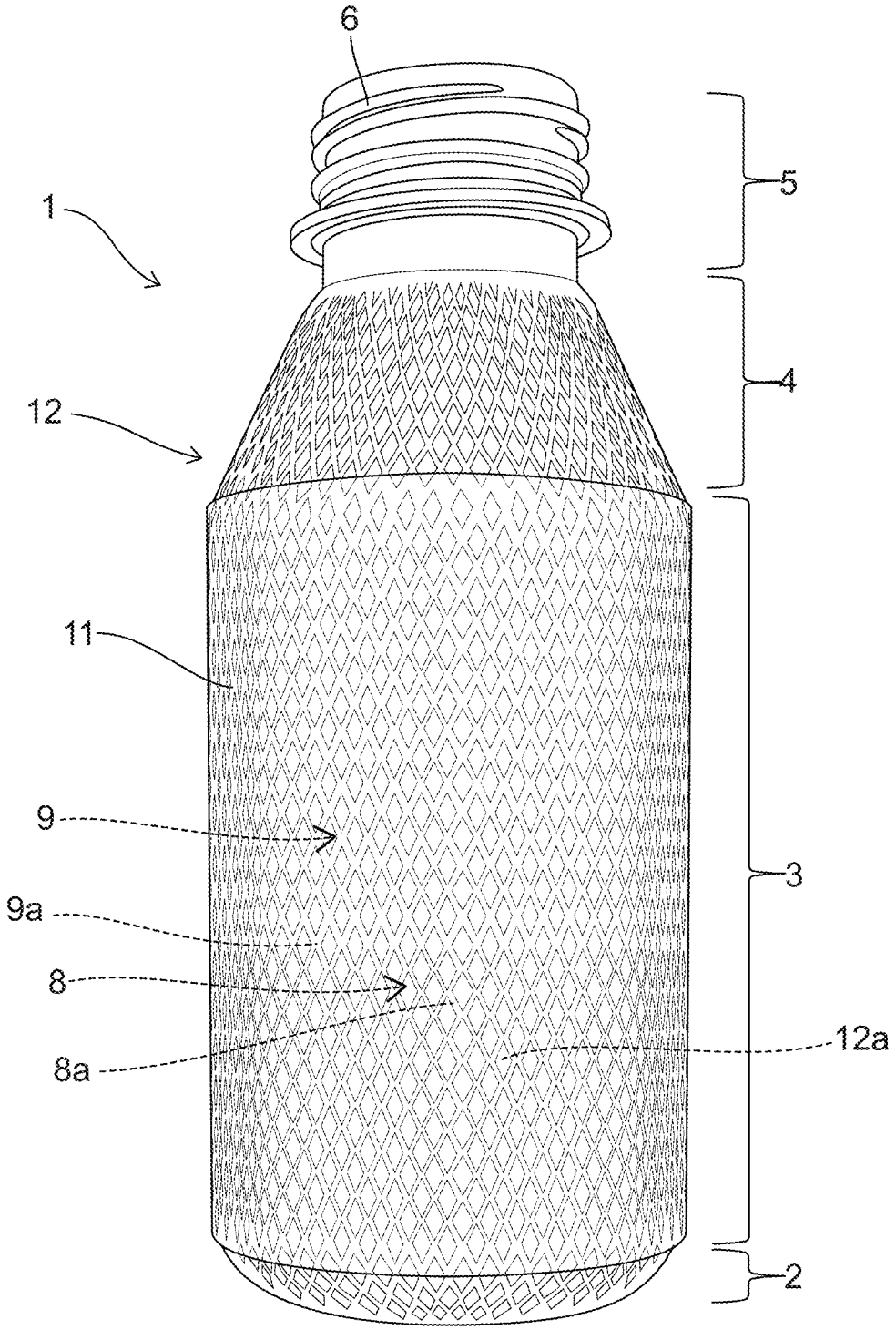
FIG. 9 is a front view of a synthetic resin bottle in a third embodiment of the present invention.
Figure 10:
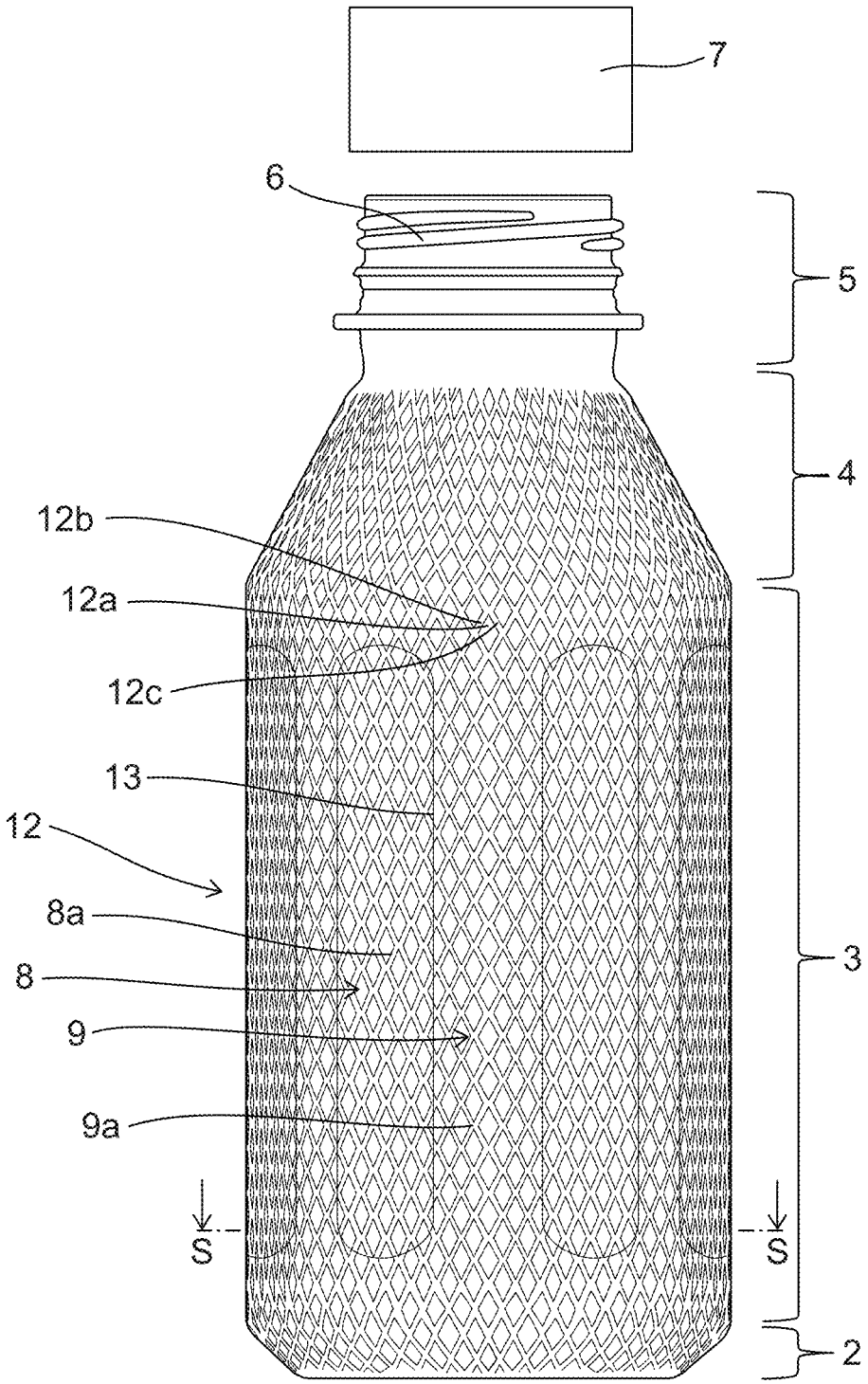
FIG. 10 is a front view of a main part of the synthetic resin bottle shown in FIG. 9 from which a label is omitted.
Figure 11:
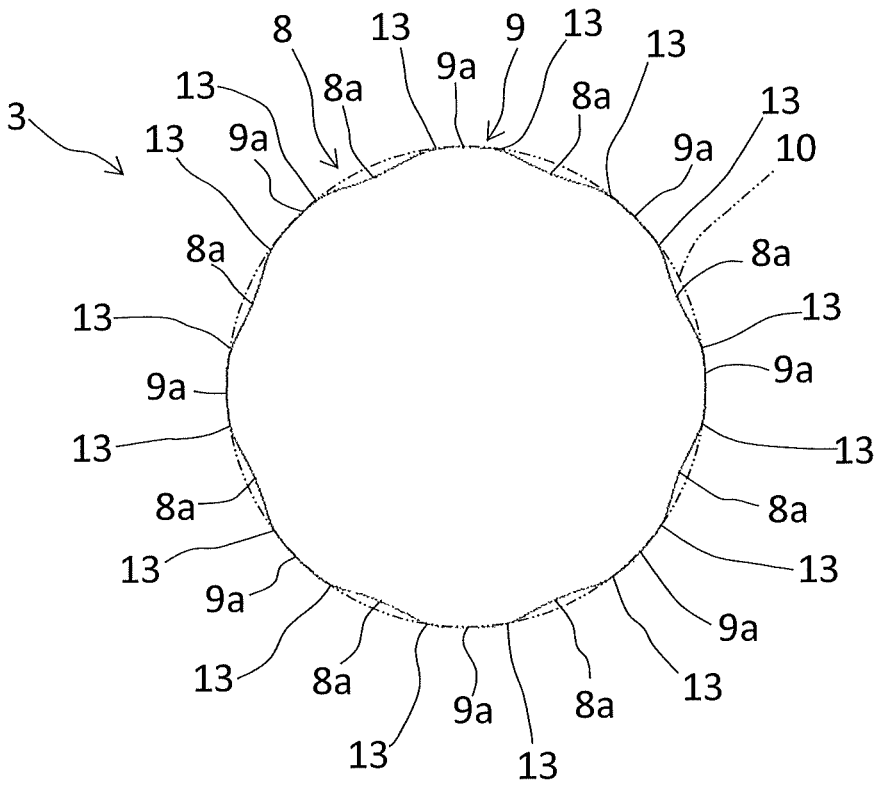
FIG. 11 is a cross sectional view schematically showing, with a contour line, an external shape of a position indicated by S-S line in FIG. 10.

FIG. 9 shows a front view of synthetic resin bottle 1 in a third embodiment. FIG. 10 shows a front view of a main part in which a label is omitted from synthetic resin bottle 1 shown in FIG. 9. FIG. 11 schematically shows a cross sectional shape along S-S line in FIG. 10. As in the first embodiment, synthetic resin bottle 1 is mainly made of synthetic resin such as polyethylene terephthalate (PET). Heel section (bottom section) 2, tube-shaped body section 3, taper-shaped (substantially conical) shoulder section 4, and small-diameter neck section 5 are provided upward from the bottom. Synthetic resin bottle 1 is capable of self-supporting. Screw cap 7 (FIG. 10) including the female screw section (not illustrated) is screwed with male screw section 6 of the outer circumference of the opening section at the end portion of neck section 5 and sealed. As shown in FIG. 9, label 11 (omitted in FIGS. 10 and 11) is disposed (attached) on the outer circumference of body section 3. As label 11, a well-known roll label (wound label) or shrink label is used.

[Structure of the Body Section]

As shown in FIGS. 9 to 11, a plurality of (e.g., eight) decompression absorbing panels 8, whose tops and bottoms are formed in an arcuate shape, including recessed sections 8*a* are disposed at equal intervals in body section 3 of synthetic resin bottle 1. Pillar sections 9 are respectively provided between decompression absorbing panels 8. Decompression absorbing panels 8 have an elongated shape in which a contour is formed by a ridge line. When a beverage is an aseptic (normal-temperature) filled beverage, a decrease in the internal pressure of synthetic resin bottle 1, after filling and sealing, is small compared with high-temperature filling and sealing. Therefore, because it is unnecessary to form the contour as a clear ridge line, it is possible to form shallow recessed sections 8*a* of decompression absorbing panels 8 and form rounded edges to make contour less conspicuous, in order to form body section 3 whose shape is relatively similar to a cylindrical shape in advance. The longitudinal direction of decompression absorbing panels 8 preferably coincide with the longitudinal direction (the vertical direction) of body section 3 or incline with respect to the longitudinal direction of body section 3. However, the longitudinal direction of decompression absorbing panels 8 may be orthogonal to the longitudinal direction of body section 3 or may be an uninterrupted annular recessed section which surrounds body section 3. Pillar sections 9 are formed by arcuate wall surfaces 9*a*. Arcuate wall surfaces 9*a* of all pillar sections 9 in the cross section of body section 3 shown in FIG. 11 respectively configure parts of one imaginary perfect circle 10. On the other hand, the wall surfaces of decompression absorbing panels 8 have a concave shape or a planar shape and do not overlap imaginary perfect circle 10 configured by connecting arcuate wall surfaces 9*a* of all pillar sections 9. Ridge lines 13 extending in the longitudinal direction of decompression absorbing panels 8 are located in the boundaries between decompression absorbing panels 8 and pillar sections 9 (arcuate wall surface 9*a*) (see FIGS. 10 and 11). Ridge lines 13 are substantially the same as edge 9*b* (see FIG. 3) explained above. In this embodiment, decorative section 12 for causing a visual illusion that the outer circumference of body section 3 is a perfect circle, is provided over the entire outer circumference of body section 3. In decorative section 12, very small geometrical shape sections (in an example shown in FIG. 9, very small parallelograms) 12*a* are regularly arrayed. In particular, geometrical shape sections 12*a* are arrayed side by side in a direction crossing ridge lines 13 extending in the longitudinal direction of decompression absorbing panels 8.

Technical Idea of this Embodiment

A technical idea of this embodiment is explained.

Figure 12:
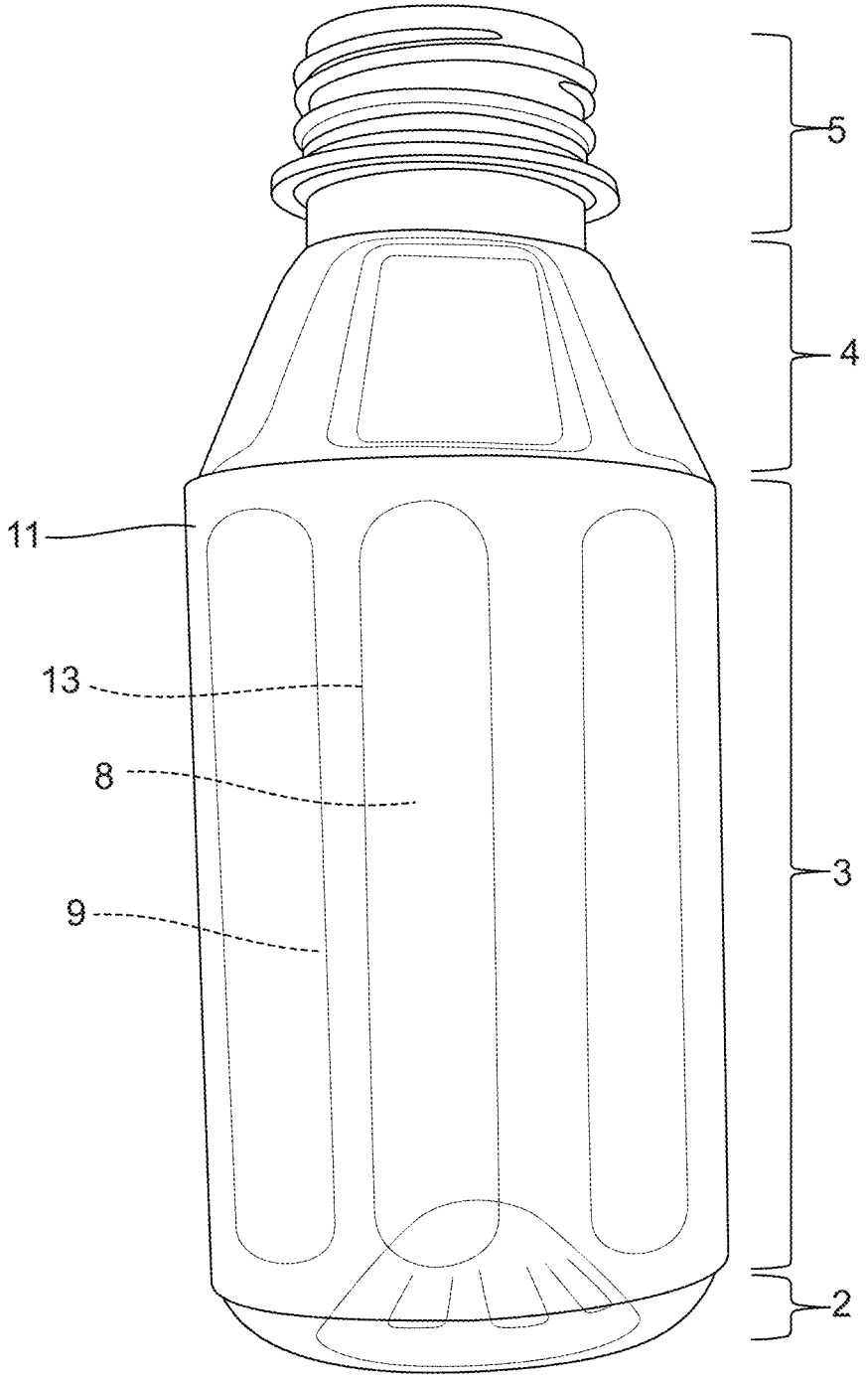
FIG. 12 is a front view of a general synthetic resin bottle.
Figure 13:
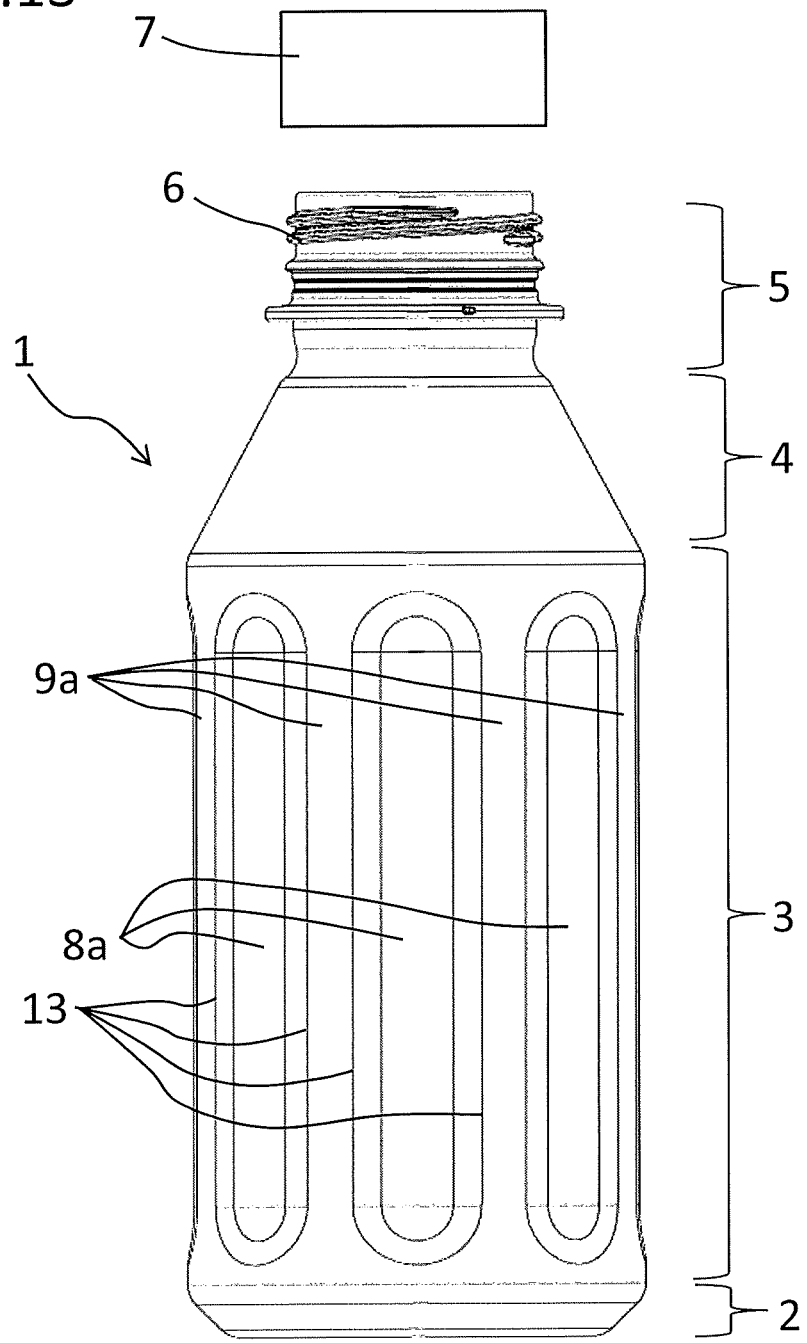
FIG. 13 is a front view of a main part of the synthetic resin bottle shown in FIG. 12 from which a label is omitted.

As shown in FIGS. 12 and 13, the general synthetic resin bottle has a configuration in which decompression absorbing panels 8 and pillar sections 9 including arcuate wall surfaces 9*a* (see FIG. 13) are alternately located side by side in the outer circumference of body section 3. Label 11 is attached to the outer circumference of such body section 3 (see FIG. 12). Label 11 is attached to the outer circumference of body section 3 and recessed sections 8*a* of decompression absorbing panels 8 are covered, whereby recessed sections 8*a* themselves of decompression absorbing panels 8 are slightly less conspicuous through label 11 even when a transparent portion or a semitransparent portion is present in label 11. However, as shown in FIG. 12, ridge lines (ridge lines located in the boundaries between decompression absorbing panels 8 and pillar sections 9) 13 extending in the longitudinal direction of decompression absorbing panels 8 and forming the contours of decompression absorbing panels 8 are conspicuous even through label 11. Since ridge lines 13 are conspicuous, the outer circumference of body section 3 tends to be recognized as not being a perfect circle.

Therefore, in this embodiment, as shown in FIG. 10, very small geometrical shape sections (e.g., very small parallelograms) 12*a* are arrayed side by side along a direction crossing ridge lines 13 so that ridge lines 13 are less easily recognized. Ridge lines 13 and rows of geometrical shape sections 12*a* cross each other, whereby ridge lines 13 become less conspicuous and the boundaries between decompression absorbing panels 8 and pillar sections 9 are less easily recognized. As a result, a visual illusion effect is obtained in which entire body section 3 is seen as if body section 3 has a curved surface whose shape is equal to or similar to the shape of a perfect circle on which ridge lines 13 and recessed sections 8*a* of decompression absorbing panels 8 are absent. By providing decorative section 12 formed by such geometrical shape sections 12*a*, it is possible to give an impression, by means of a visual illusion, that the shape is almost the same as that of a perfect circle, although the rough external shape of entire body section 3 including recessed sections 8*a* of decompression absorbing panels 8 is not changed. In particular, as shown in FIG. 9, this is more effective when seen in a state in which label 11 including a transparent portion or a semitransparent portion is attached to body section 3.

In the embodiment shown in FIGS. 9 to 11, a large number of grooves 12*b* and 12*c*, which are straight lines respectively extending in two directions crossing ridge lines 13 and crossing each other, are formed in the outer circumference of body section 3, whereby very small quadrangle (parallelogram) portions surrounded by grooves 12*b* and 12*c* are relatively convex. These portions are referred to as geometrical shape sections 12*a* for convenience. Parallelogram convex geometrical shape sections 12*a* formed in this way are arrayed side by side along grooves 12*b* and 12*c* forming the contours of geometrical shape sections 12*a*, that is, located side by side in the direction crossing ridge lines 13. Decorative section 12 has substantially the same configuration as the configuration of embossed section 12E in the embodiment shown in FIG. 8.

[Detailed Structure of the Geometrical Shape Section]

The shape and the dimensions of such decorative section 12 are explained. Concerning grooves 12*b* and 12*c*, which are the straight lines configuring the contours of geometrical shape sections 12*a*, not all of grooves 12*b* and 12*c* need to have the same width. For example, as enlarged and shown in FIGS. 14 and 15, thick grooves 12*bi* and 12*ci* may be included in grooves 12*b* and 12*c*. Thick grooves 12*bi* and 12*ci* are preferably cyclically disposed rather than being disposed at random. The width of grooves 12*b* and 12*c* including these thick grooves 12*bi* and 12*ci* is preferably in a range of 5% to 100% of the width of geometrical shape sections 12*a*. If the width of the grooves is smaller than 5% of the width of geometrical shape sections 12*a*, a problem occurs in that the grooves are less easily recognized. If the width of the grooves is larger than 100% of the width of geometrical shape sections 12*a*, geometrical shape sections 12*a* and grooves 12*b* and 12*c* are respectively not conspicuous and the visual illusion effect decreases. The width is a dimension of one groove (straight line) and the geometrical shape section in a direction parallel to the other groove (straight line). In FIG. 15, the dimension (the width) of groove 12*b* in a direction parallel to grooves 12*c* and the dimension (the width) of geometrical shape section 12*a* in the same direction are shown. Although not illustrated, the dimension (the width) of grooves 12*c* in a direction parallel to groove 12*b* and the dimension (the width) of geometrical shape section 12*a* in the same direction are preferably within the same numerical range (5% to 100%).

Figure 16:
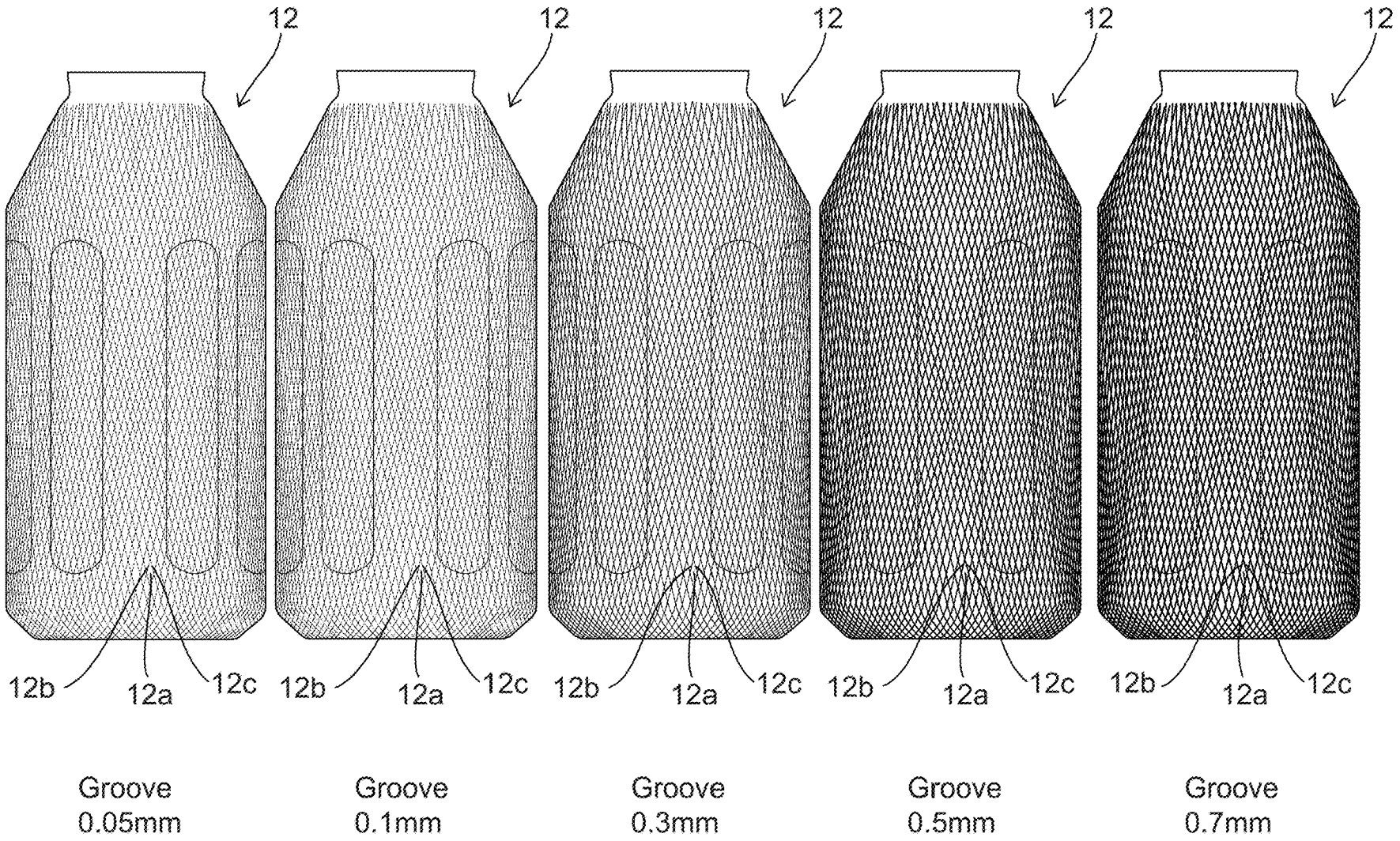
FIG. 16 is a schematic diagram showing, side by side, synthetic resin bottles having different depths of grooves of decorative sections.

When viewing FIG. 16 showing a plurality of synthetic resin bottles having different depths of grooves 12*b* and 12*c*, the depths of grooves 12*b* and 12*c* are preferably 0.1 mm to 0.5 mm. When grooves 12*b* and 12*c* are shallower than 0.1 mm, the effect of making ridge lines 13 less conspicuous is small. Further, when formativeness during blow molding is poor, grooves 12*b* and 12*c* themselves become invisible.

When grooves 12*b* and 12*c* are deeper than 0.5 mm, a problem occurs in that the strength of synthetic resin bottle 1 is deteriorated, decompression absorbing deformation of recessed sections 8*a* of decompression absorbing panels 8 is hindered, it is necessary to form a high ridge in a blow molding die, and therefore, metal durability is deteriorated or synthetic resin bottle 1 is scratched by the die ridge during release after the blow molding.

Figure 17A:
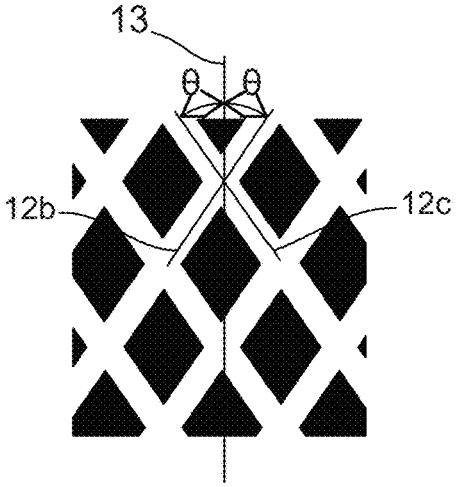
FIG. 17A is a schematic diagram showing an angle formed by a straight line forming a contour of a geometrical shape section of the decorative section and a ridge line.
Figure 17B:
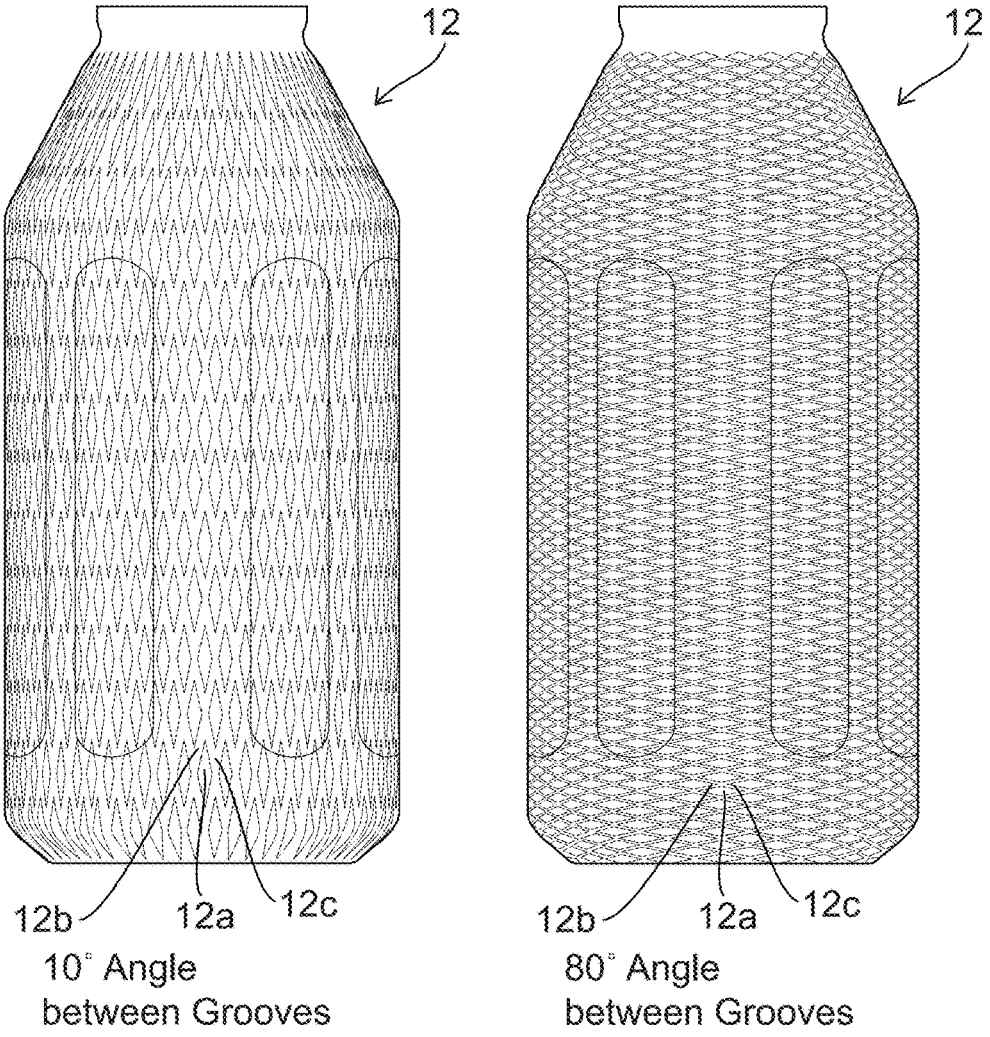
FIG. 17B is a schematic diagram showing, side by side, synthetic resin bottles having different angles formed by straight lines forming contours of geometrical shape sections of decorative sections and ridge lines.

An angle θ at which grooves 12*b* and 12*c* cross ridge line 13 shown in FIG. 17A is preferably 10° to 80° as shown in FIG. 17B. When angle θ of grooves 12*b* and 12*c* deviates from this range, since geometrical shape sections 12*a* are located side by side in a direction nearly perpendicular or parallel to ridge line 13, the effect of making ridge line 13 less conspicuous is small.

Figure 18A:
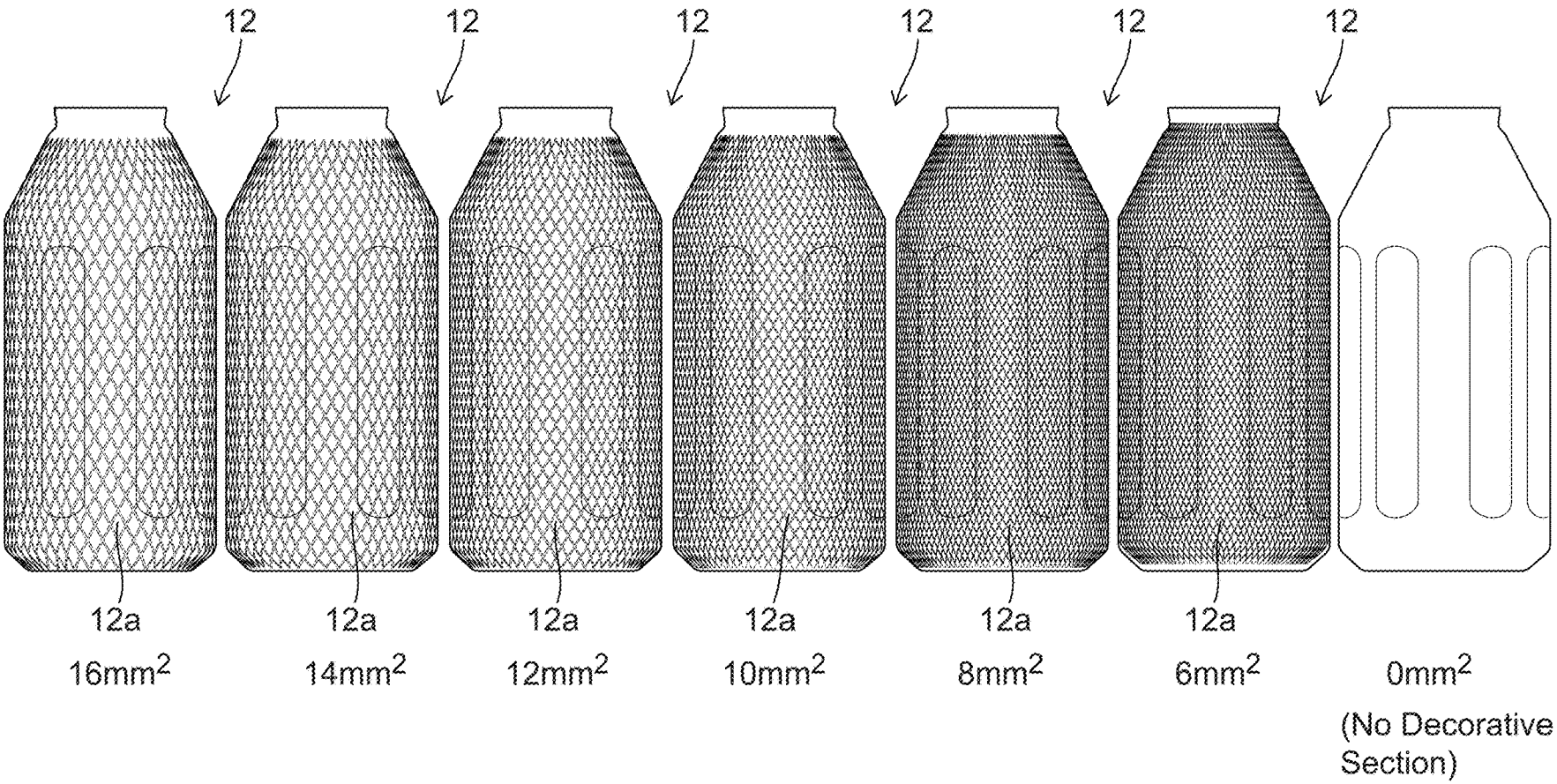
FIG. 18A is a schematic diagram showing, side by side, synthetic resin bottles having different sizes of geometrical shape sections of decorative sections.
Figure 18B:
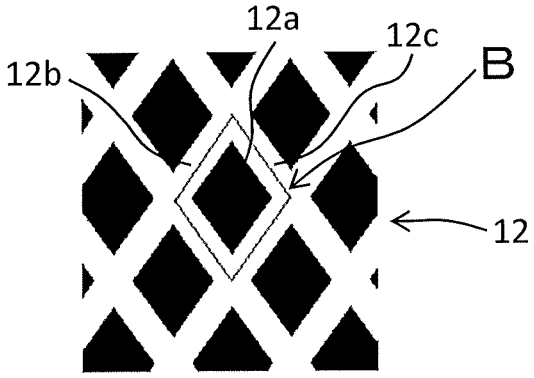
FIG. 18B is a schematic diagram showing a measurement range of the size of a geometrical shape section of a decorative section.

As the size of geometrical shape section 12*a*, as shown in FIGS. 18A and 18B, the area of a range surrounded by center lines of grooves 12*b* and 12*c* forming the contour (B portion in FIG. 18B) is preferably within a range of 3 $mm^2$ to 15 $mm^2$. When geometrical shape sections 12*a* is too small (smaller than 3 $mm^2$), the formativeness during blow molding is deteriorated. The geometrical shape and the shape of the grooves tend to be blurred. Therefore, decorative section 12 is not substantially different from an irregular and fine uneven rough surface. The formed ridge line 13 is conspicuous and the visual illusion effect decreases. When geometrical shape section 12*a* is too large (larger than 15 $mm^2$), ridge line 13 is not very conspicuous. The visual illusion effect for giving the impression that a body section 3 is cylindrical is small.

Figure 14:
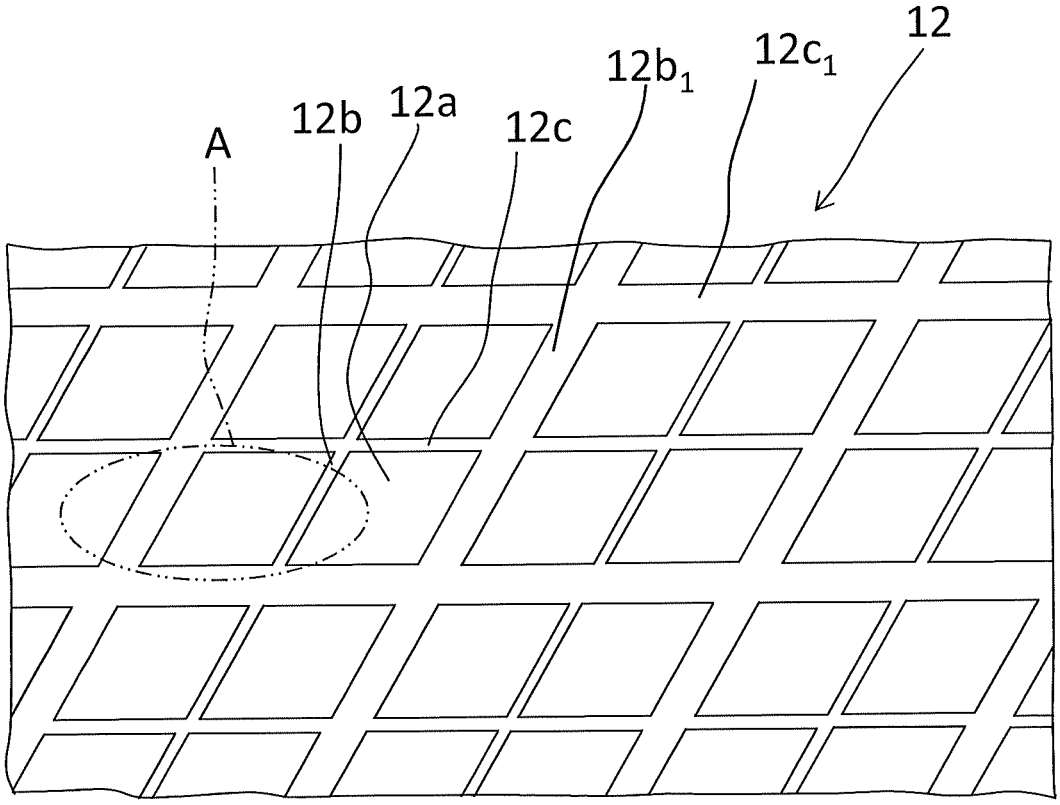
FIG. 14 is an enlarged view of a decorative section of the synthetic resin bottle shown in FIG. 9.
Figure 15:
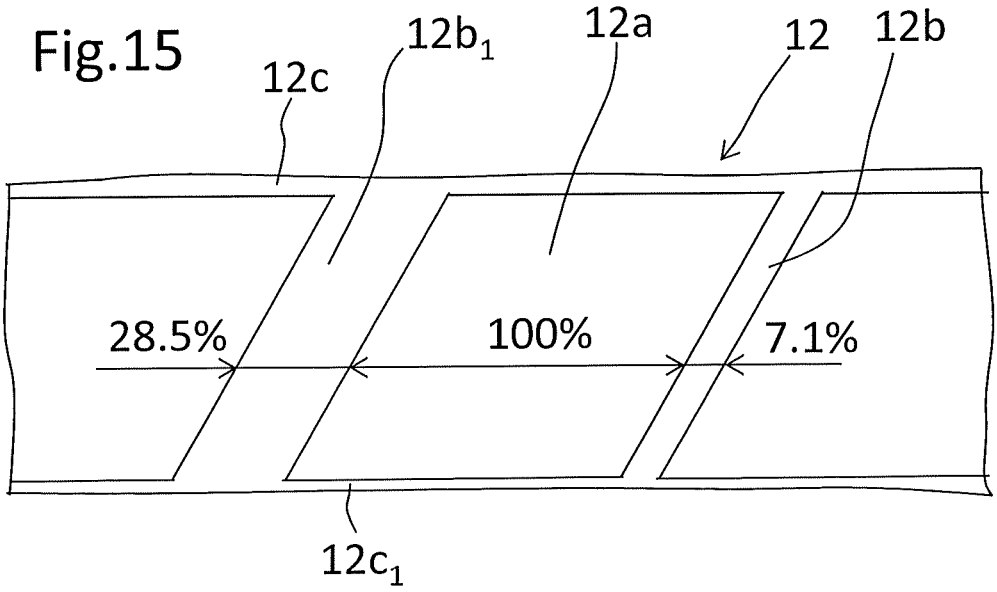
FIG. 15 is a further enlarged view of an A portion in FIG. 14.

Geometrical shape section 12*a* is not limited to the formativeness (the parallelogram) and may be a formativeness having rounded corners, a circular shape, an elliptical shape, and the like or may be a polygonal shape (a triangle, a polygon having five or more sides, and the like), other than the parallelogram, formed by adding additional grooves or cutout portions to the configuration shown in FIGS. 14 and 15. When the geometrical shape sections are polygon, it is preferably to array the geometrical shape sections side by side along any side and to cause the geometrical shape sections to cross the ridge line because a visual illusion effect by grooves and ridges in addition to the array of the geometrical shape sections is obtained. Note that the polygon may be a shape that has rounded corners.

Figure 19A:
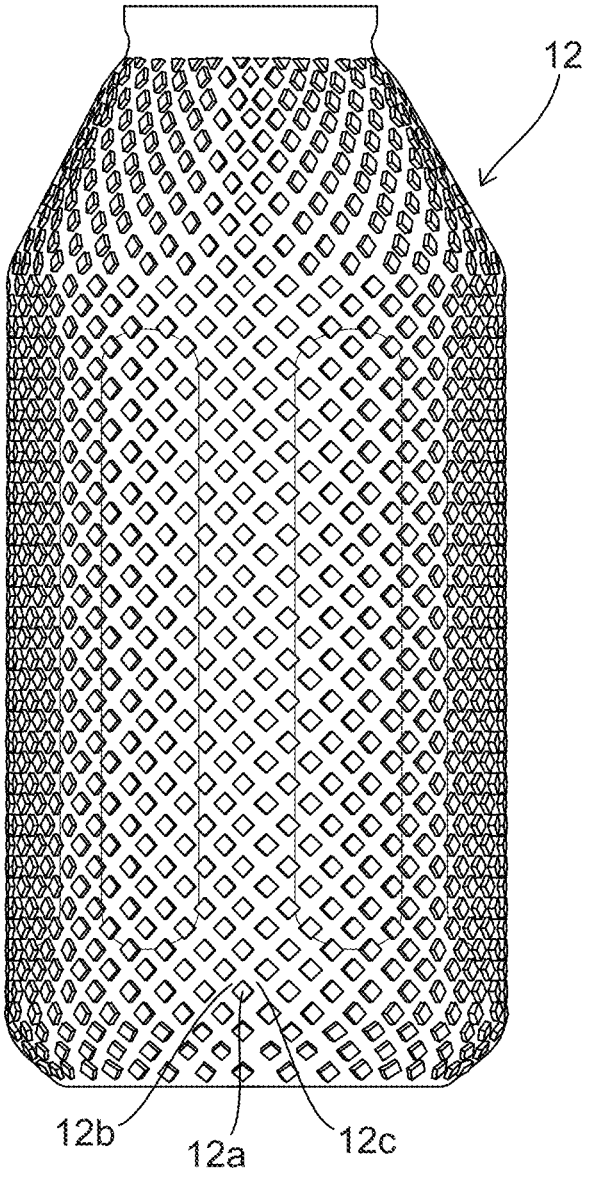
FIG. 19A is a schematic diagram showing a synthetic resin bottle including a convex geometrical shape section.
Figure 19B:
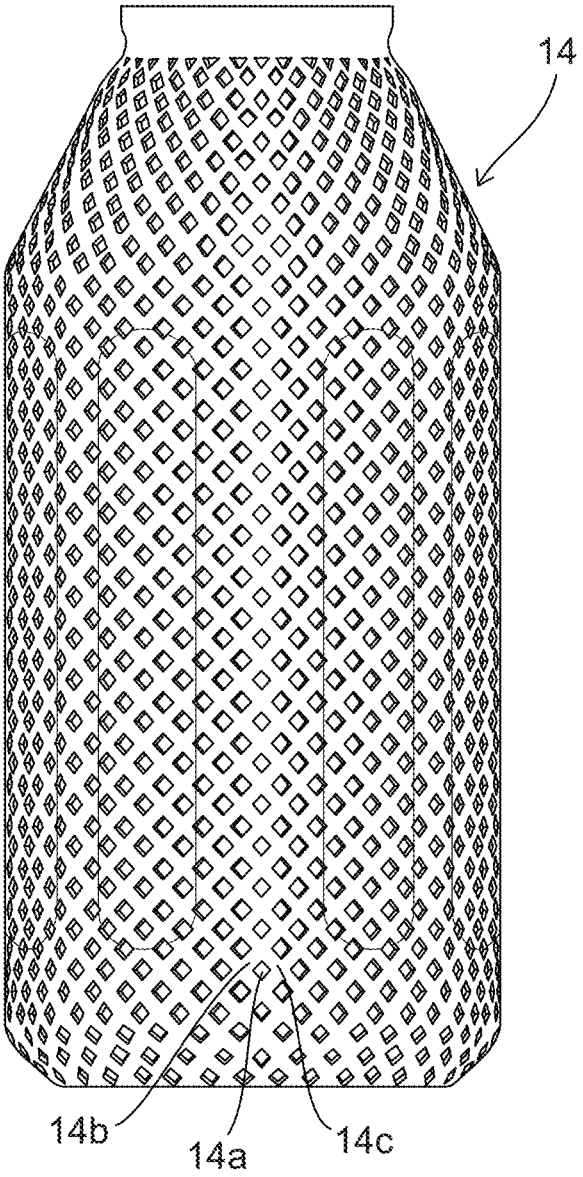
FIG. 19B is a schematic diagram showing a synthetic resin bottle including a concave geometrical shape section.

In the embodiment shown in FIG. 19A, decorative section 12 is configured by geometrical shape sections 12*a* of a parallelogram or the like relatively formed in a convex shape by grooves 12*b* and 12*c* formed on the outer circumference of body section 3. However, the decorative section in this embodiment is not limited to such a configuration. As shown in FIG. 19B, for example, linear ridges 14*b* and 14*c* outward swelling from the outer circumference of body section 3 can be formed instead of grooves 12*b* and 12*c*. Geometrical shape section 14*a* of a very small quadrangle (parallelogram) surrounded by ridges 14*b* and 14*c* and relatively formed in a concave shape can be formed. That is, it is possible to achieve the visual illusion effect to give the impression that the external shape of body section 3 is a perfect circle, irrespective of whether the decorative section is decorative section 12 formed by convex geometrical shape section 12*a* as shown in FIG. 19A or decorative section 14 formed by concave geometrical shape sections 14*a* as shown in FIG. 19B.

With the synthetic resin bottle in which decorative section 12 or 14 including convex or concave geometrical shape sections 12*a* or 14*a* according to this embodiment, when a high-temperature beverage is enclosed, the effect of preventing a purchaser from easily feeling heat (prevent heat from being easily transferred to the purchaser) when the purchaser holds the synthetic resin bottle is obtained. A main cause of this is that, since convex or concave geometrical shape sections 12*a* or 14*a* are present, the contact area between body section 3 and label 11 decreases and the transfer of the heat decreases.

This embodiment is not limited to the configuration in which the decorative section is provided by forming the convex or concave geometrical shape sections on the outer circumference of body section 3. That is, although not illustrated, the decorative section can also be provided by forming the geometrical shape sections by printing on label 11 disposed on the outer circumference of body section 3 without providing the decorative section in body section 3. In that case, the geometrical shape sections are two-dimensional (planar) patterns not having three-dimensional (solid) structure. However, it is possible to achieve the visual illusion effect to give the impression that the external shape of body section 3 is a perfect circle.

The synthetic resin bottle in this embodiment explained above can obtain the effect that the exterior appearance of body section 3 attached with label 11 is seen as the perfect circle cylindrical shape while maintaining the decompression absorbing performance in which recessed sections 8*a* of decompression absorbing panels 8 sufficiently absorb decompression and reduce deformation of container 1. When the geometrical shape sections have a shape other than the parallelogram, when the geometrical shape sections are concave rather than convex, and when the geometrical shape sections are two-dimensional patterns formed by printing on the label, the geometrical shape sections preferably have the shape and the relationship between the dimensions (in the case of the two-dimensional patterns, the depth and the height are excluded) explained above.

Note that decompression absorbing panels 8 of the synthetic resin bottle are not limited to decompression absorbing panels 8 having the shape extending along the vertical direction and may be decompression absorbing panels 8 that are inclined with respect to the vertical direction or decompression absorbing panels 8 that extend in the horizontal direction. In those cases as well, a plurality of geometrical shape sections are preferably arrayed side by side in the direction crossing the ridge lines that extends in the longitudinal direction of decompression absorbing panels 8 and that forms the contours of decompression absorbing panels 8.

The synthetic resin bottle of the present invention is not limitedly used for the aseptic (normal-temperature) filled beverage and may be used for a high-temperature filled beverage. In that case, dent of recessed sections 8*a* of decompression absorbing panels 8 and the ridge lines are preferably prevented as much as possible. For example, it is preferable to reduce the load of recessed sections 8*a* of decompression absorbing panels 8 concurrently using decompression absorption by a well-known bottle bottom section.

Label 11 including the transparent portion or the semi-transparent portion is not essential. Label 11 may be partially attached to body section 3 (decompression absorbing panels 8). In that case, even if the label does not include the decorative section of the present invention and is entirely opaque, if any one of the configurations of the present invention is adopted in a part to which the label is not attached, it is possible to obtain the effect that the exterior appearance of body section 3 is seen as a cylindrical shape by means of the visual illusion effect. If label 11 is unnecessary, label 11 may not be attached.

The plurality of embodiments of the present invention explained above can be optionally combined. It is possible to further improve the effect that the exterior appearance of body section 3 is seen as a perfect circle cylindrical shape.

EXPLANATION OF REFERENCE NUMERALS

1 synthetic resin bottle
2 heel section (bottom section)
3 body section
4 shoulder section
5 neck section
6 male screw section
7 screw cap
8 decompression absorbing panel
8*a* recessed section
8*b* circumferential direction center
8*c* end portion
9 pillar section
9*a* arcuate wall surface
9*b* edge
9*c* circumferential direction center
10 imaginary perfect circle
11 label (shrink label)
12, 14 decorative section
12*a*, 14*a* geometrical shape section
12*b*, 12*c* groove (straight line)
12E embossed section
13 ridge line
14*b*, 14*c* ridge (straight line)

The invention claimed is:

1. A synthetic resin bottle which is structured for aseptic filling only, including a tube-shaped body section comprising:

eight decompression absorbing panels configured to absorb decompression after the bottle which is structured for aseptic filling only is filled with a beverage at normal temperature and the bottle is sealed, which are disposed at equal intervals in said body section; and pillar sections respectively disposed between said decompression absorbing panels and formed by arcuate wall surfaces, wherein said arcuate wall surfaces of said pillar sections in a cross section of said body section configure parts of one imaginary perfect circle, and a total of circumferential lengths of said arcuate wall surfaces of said pillar sections is 20 to 50% of a total circumferential length of said perfect circle, wherein in a horizontal cross section of said body section, said decompression absorbing panels include a recessed section including a curved line having a curvature radius equal to or larger than 15 mm.

2. A synthetic resin bottle which is structured for aseptic filling only, including a tube-shaped body section comprising:

eight decompression absorbing panels configured to absorb decompression after the bottle which is structured for aseptic filling only is filled with a beverage at normal temperature and the bottle is sealed, which are disposed at equal intervals in said body section; and pillar sections respectively disposed among said decompression absorbing panels and formed by arcuate wall surfaces, wherein said arcuate wall surfaces of said pillar sections in a cross section of said body section configure parts of one imaginary perfect circle, and an angle formed by a radial direction line passing through a circumferential direction center of said pillar sections and a radial direction line passing through an edge of said pillar sections in a circumferential direction is 20 to 50% of an angle formed by said radial direction line passing through the circumferential direction center of said pillar sections and a radial direction line passing through a circumferential direction center of said decompression absorbing panels adjacent to said pillar sections, wherein in a horizontal cross section of said body section, said decompression absorbing panels include a recessed section including a curved line having a curvature radius equal to or larger than 15 mm.

3. The synthetic resin bottle according to claim 1, wherein said synthetic resin bottle is a bottle for sales while being warmed.

4. The synthetic resin bottle according to claim 1, wherein an embossed section is provided on at least an outer circumferential surface of said body section.

5. A synthetic resin bottle which is structured for aseptic filling only, including a tube-shaped body section, wherein said body section includes eight decompression absorbing panels configured to absorb decompression after the bottle which is structured for aseptic filling only is filled with a beverage at normal temperature and the bottle is sealed, a plurality of geometrical shape sections are regularly disposed side by side over an entire circumference of said body section, pillar sections respectively disposed between said decompression absorbing panels and formed by arcuate wall surfaces, wherein in a horizontal cross section of said body section, said decompression absorbing panels include a recessed section including a curved line having a curvature radius equal to or larger than 15 mm.

6. The synthetic resin bottle according to claim 5, wherein said decompression absorbing panels have an elongated shape, and said plurality of geometrical shape sections are arrayed side by side in a direction crossing a ridge line that extends in a longitudinal direction of said decompression absorbing panels and forms a contour of said decompression absorbing panels.

7. The synthetic resin bottle according to claim 6, wherein a crossing angle of the arraying direction of said geometrical shape sections and said ridge line is 10 degrees to 80 degrees.

8. The synthetic resin bottle according to claim 6, wherein the longitudinal direction of said decompression absorbing panels coincides with a longitudinal direction of said body section or is inclined with respect to the longitudinal direction of said body section.

9. The synthetic resin bottle according to claim 5, wherein an area of each of said geometrical shape sections is 3 $mm^2$ to 15 $mm^2$.

10. The synthetic resin bottle according to claim 5, wherein said geometrical shape section is a portion surrounded by a plurality of straight lines respectively extending in two directions crossing each other on an outer circumference of said body section.

11. The synthetic resin bottle according to claim 10, wherein a width of one of said straight lines surrounding said geometrical shape section, in a direction parallel to another of said straight lines, is 5% to 100% of a width of said geometrical shape section in the direction parallel to the another of said straight lines.

12. The synthetic resin bottle according to claim 10, wherein said straight lines are a plurality of grooves or a plurality of ridges formed in the outer circumference of said body section.

13. The synthetic resin bottle according to claim 12, wherein a depth or a height of said grooves or said ridges surrounding said geometrical shape section is 0.1 mm to 0.5 mm.

14. The synthetic resin bottle according to claim 5, wherein a convex geometrical shape section is provided in said body section.

15. The synthetic resin bottle according to claim 5, wherein a concave geometrical shape section is provided in said body section.

16. The synthetic resin bottle according to claim 5, wherein said geometrical shape section is printed on a label disposed on an outer circumference of said body section.

17. The synthetic resin bottle according to claim 1, wherein in the horizontal cross section of said body section, a path from an end portion of said decompression absorbing panels connected to an edge of said pillar sections in a circumferential direction is defined as a curved line having a curvature radius equal to or larger than 5 mm.

18. The synthetic resin bottle according to claim 2, wherein in the horizontal cross section of said body section, a path from an end portion of said decompression absorbing panels connected to an edge of said pillar sections in a circumferential direction is defined as a curved line having a curvature radius equal to or larger than 5 mm.

* * * * *